US009370082B2

(12) United States Patent
Yoneoka et al.

(10) Patent No.: US 9,370,082 B2
(45) Date of Patent: Jun. 14, 2016

(54) LIGHT SOURCE CONTROL APPARATUS AND LIGHT SOURCE CONTROL METHOD

(71) Applicant: Mitsubishi Electric Corporation, Tokyo (JP)

(72) Inventors: Isao Yoneoka, Tokyo (JP); Yoshinori Asamura, Tokyo (JP); Zenkou Yamamoto, Tokyo (JP); Haruhisa Inoue, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/834,100

(22) Filed: Aug. 24, 2015

(65) Prior Publication Data

US 2016/0095194 A1 Mar. 31, 2016

(30) Foreign Application Priority Data

Sep. 29, 2014 (JP) ..... 2014-197844

(51) Int. Cl.
*H05B 33/08* (2006.01)
*H05B 37/03* (2006.01)

(52) U.S. Cl.
CPC ..... *H05B 37/032* (2013.01); *H05B 33/089* (2013.01); *H05B 33/0827* (2013.01)

(58) Field of Classification Search
CPC ..... H05B 33/08; H05B 33/0815; H05B 33/0848; H05B 33/089; H05B 37/00; H05B 37/02
USPC ..... 315/121, 291, 294, 297, 307, 308
See application file for complete search history.

(56) References Cited

U.S. PATENT DOCUMENTS

2004/0080273 A1* 4/2004 Ito ..... H05B 33/0815 315/77
2011/0062872 A1* 3/2011 Jin ..... H05B 33/0818 315/122

FOREIGN PATENT DOCUMENTS

JP 2007-95391 A 4/2007
JP 2007-96113 A 4/2007

* cited by examiner

*Primary Examiner* — Thai Pham
(74) *Attorney, Agent, or Firm* — Birch, Stewart, Kolasch & Birch LLP

(57) ABSTRACT

A controller determines whether parallel-connected light sources include a faulty light source. When a faulty light source is included, the controller controls at least one of a current supply unit and a switching unit such that a current is continuously supplied to normal light sources being light sources of the light sources except for the faulty light source.

5 Claims, 5 Drawing Sheets

LIGHT SOURCE CONTROL APPARATUS AND LIGHT SOURCE CONTROL METHOD

BACKGROUND OF THE INVENTION

1. Field of the Invention

The present invention relates to a light source control apparatus and a light source control method for controlling a plurality of parallel-connected light sources.

2. Background Art

It has recently been suggested that a collection of a plurality of light emitting diodes (LEDs) electrically connected in parallel be used as a light source for a projection image display apparatus. Connecting LEDs in parallel can drive a large number of LEDs at low voltage. Besides, turning on a plurality of LEDs can obtain a high-luminance light source. An apparatus including a light source composed of a plurality of parallel-connected LEDs can therefore reduce the power consumption of the entire apparatus compared with a conventional apparatus including a lamp light source.

An apparatus including a plurality of LEDs needs to control the luminance of each LED. Japanese Patent Application Laid-Open Nos. 2007-095391 (paragraphs 0013 to 0016. FIG. 1) and 2007-096113 (paragraphs 0018 and 0019, FIG. 1) each disclose the technology (hereinafter, also referred to as "related art A") of controlling a plurality of LEDs.

Unfortunately, with the configuration including a light source unit composed of a plurality of parallel-connected LEDs, all of the LEDs may fail to light up due to any fault occurring in only one of the plurality of LEDs.

For example, if a short-circuit fault occurs in one of a plurality of LEDs constituting a light source unit, the LED having a short-circuit fault is intensively supplied with a drive current from a constant current circuit. Consequently, all the LEDs do not light up.

SUMMARY OF THE INVENTION

The present invention has an object to provide a light source control apparatus and a light source control method capable of allowing a light source to continuously emit light even if a fault occurs in any of a plurality of parallel-connected light sources.

A light source control apparatus according to an aspect of the present invention controls a plurality of light sources that are connected in parallel and emit light when supplied with a current. The light source control apparatus includes a current supply unit that collectively supplies a current to the plurality of light sources, a first current sensing unit that senses a first current being the current collectively supplied to the plurality of light sources by the current supply unit, a second current sensing unit that senses a second current being a current supplied to at least one of the plurality of light sources, a switching unit having a function of stopping the supply of a current to each of the plurality of light sources, and a controller that determines whether the plurality of light sources include a faulty light source on the basis of the first current and the second current. When the plurality of light sources include the faulty light source, the controller further controls at least one of the current supply unit and the switching unit such that a current is continuously supplied to a normal light source being a light source of the plurality of light sources except for the faulty light source.

According to the present invention, the controller determines whether a plurality of parallel-connected light sources include a faulty light source. When the plurality of parallel-connected light sources include a faulty light source, the controller controls at least one of the current supply unit and the switching unit such that a current is continuously supplied to a normal light source being a light source of the plurality of light sources except for the faulty light source.

Therefore, a light source can continuously emit light even if a fault occurs in any of a plurality of parallel-connected light sources.

These and other objects, features, aspects and advantages of the present invention will become more apparent from the following detailed description of the present invention when taken in conjunction with the accompanying drawings.

DESCRIPTION OF THE PREFERRED EMBODIMENTS

The following describes the preferred embodiments of the present invention with reference to the drawings. In the description below, the same components are denoted by the same references, which holds true for their names and functions. Their detailed description may therefore be omitted.

Comparative Example

Figure 5:
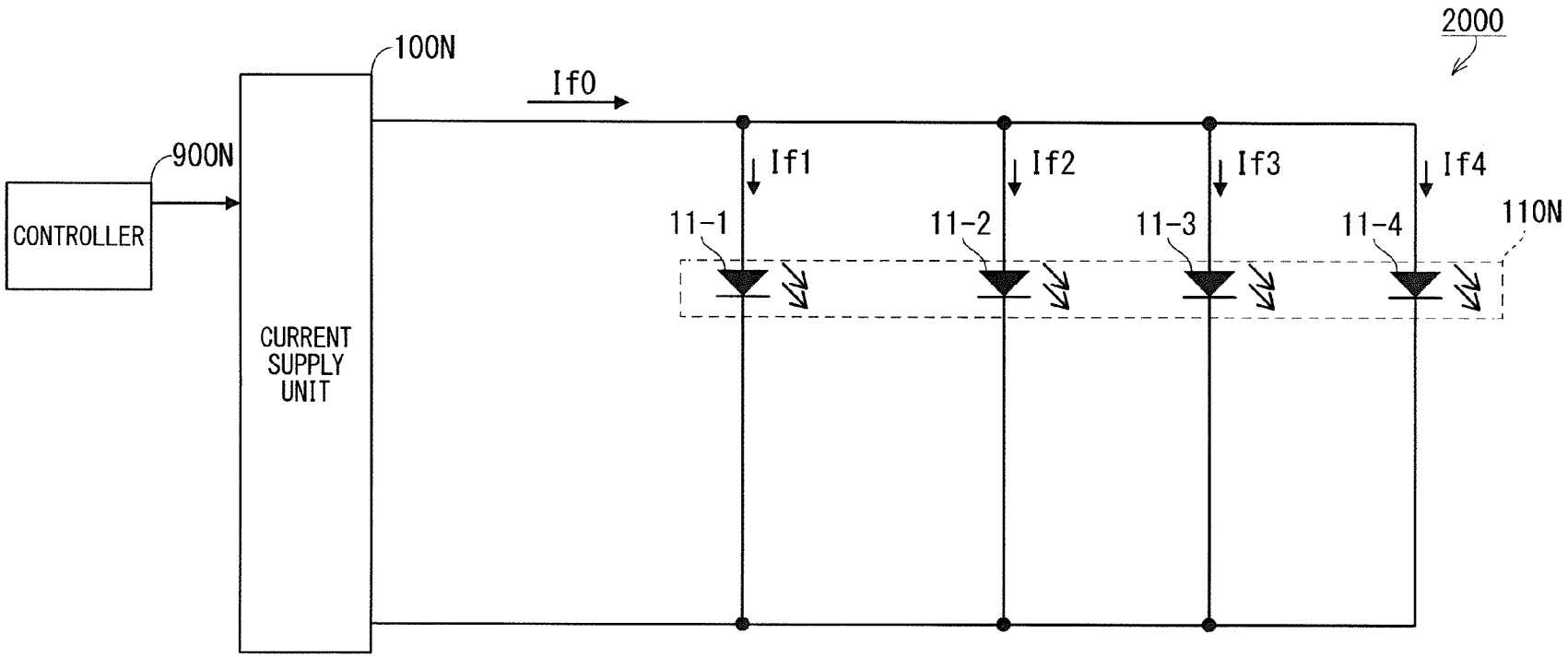
FIG. 5 shows the configuration of a light source control apparatus according to a comparative example.

The following describes a light source control apparatus as a comparative example. FIG. 5 shows the configuration of a light source control apparatus 2000 according to the comparative example. The light source control apparatus 2000 is an apparatus including a plurality of light sources electrically connected in parallel.

With reference to FIG. 5, the light source control apparatus 2000 includes a current supply unit 100N, a light source unit 110N, and a controller 900N.

The light source unit 110N includes light sources 11-1, 11-2, 11-3, and 11-4. The light sources 11-1, 11-2, 11-3, and 11-4 are electrically connected in parallel. Hereinafter, each of the light sources 11-1, 11-2, 11-3, and 11-4 is merely referred to as a "light source 11" as well. The light source 11 is, for example, an LED.

The controller 900N controls the current supply unit 100N. The controller 900N is, for example, a microcomputer such as a micro processing unit (MPU). The current supply unit 100N is a constant current circuit that supplies a predetermined drive current If0 to the light source unit 110N in accordance with the control by the controller 900N. Specifically, the current supply unit 100N supplies a current to the light sources 11-1, 11-2, 11-3, and 11-4. This causes each of the light sources 11-1, 11-2, 11-3, and 11-4 to emit light.

The luminance of the light emitted from an LED varies in accordance with a supplied current. The light source control apparatus 2000 has a configuration that allows a user to set the drive current If0 via the controller 900N using, for example, a user interface to acquire a predetermined luminance.

With the configuration of the light source control apparatus 2000, unfortunately, all the light sources 11 do not light up due to any fault occurring in only one light source 11 of the plurality of light sources 11, as described above.

For example, if a short-circuit fault occurs in one of the four light sources 11 included in the light source unit 110N, the light source 11 having a short-circuit fault is intensively supplied with the drive current from the current supply unit 100N.

Suppose that an open-circuit fault has occurred in one of the four light sources 11 included in the light source unit 110N. In this case, a current exceeding a rated current may flow through the other normal light sources 11 depending on the current value of the drive current If0. This causes another fault and, in the worst case, a fault occurs in all the light sources 11.

The embodiments below therefore solve the problem described in the comparative example.

First Preferred Embodiment

Figure 1:
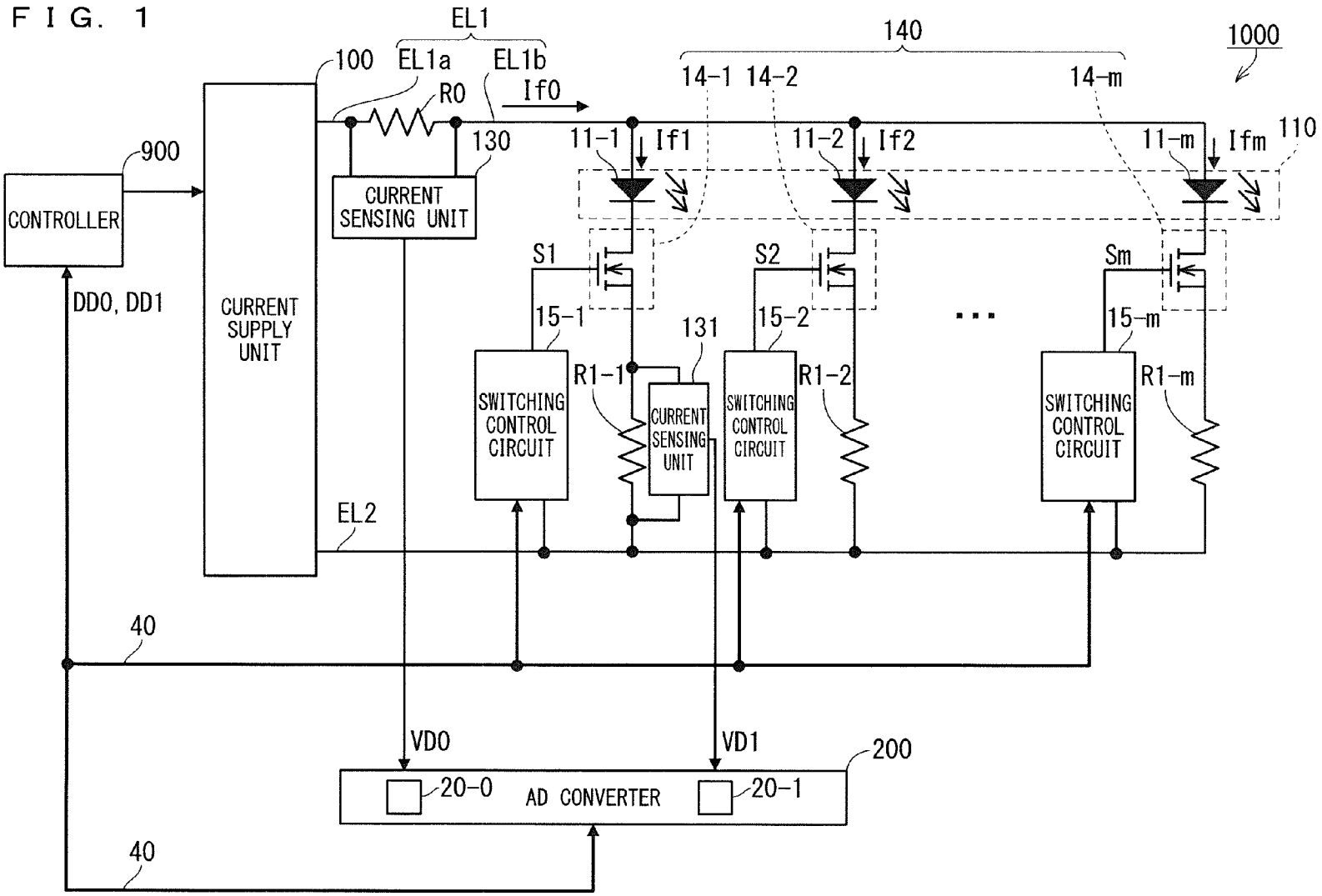
FIG. 1 is a block diagram showing the configuration of a light source control apparatus according to a first preferred embodiment of the present invention.

FIG. 1 is a block diagram showing the configuration of a light source control apparatus 1000 according to a first preferred embodiment of the present invention. The light source control apparatus 1000 is, for example, an apparatus used as a light source for an image display apparatus that displays an image. The image display apparatus is, for example, a projection image display apparatus. The image display apparatus is not limited to the projection image display apparatus and may be another type of display apparatus.

As shown in FIG. 1, the light source control apparatus 1000 includes a current supply unit 100, a light source unit 110, a switching unit 140, a sensing resistor R0, sensing resistors R1-1 to R1-*m* (m is a natural number not less than three), current sensing units 130 and 131, switching control circuits 15-1 to 15-*m* (m is a natural number not less than three), an AD converter 200, and a controller 900.

The light source control apparatus 1000 may include no light source unit 110. Specifically, the light source control apparatus 1000 may be configured to control an external light source unit 110.

The controller 900 controls the respective units of the light source control apparatus 1000. The controller 900 is, for example, a microcomputer such as MPU. The controller 900 performs various processes, described below, in accordance with a predetermined program.

The current supply unit 100 is connected to electric lines EL1 and EL2. The electric line EL1 is composed of an electric line EL1*a* and an electric line EL1*b*. The electric line EL1*a* is electrically connected to the electric line EL1*b* by the sensing resistor R0. The current supply unit 100 is a constant current circuit that supplies a predetermined drive current If0 to the light source unit 110 through the electric line EL1. The drive current If0 is a current for causing a light source, described below, to emit light (light up). The current supply unit 100 changes the current value of the drive current If0 in accordance with the control by the controller 900.

Figure 2:
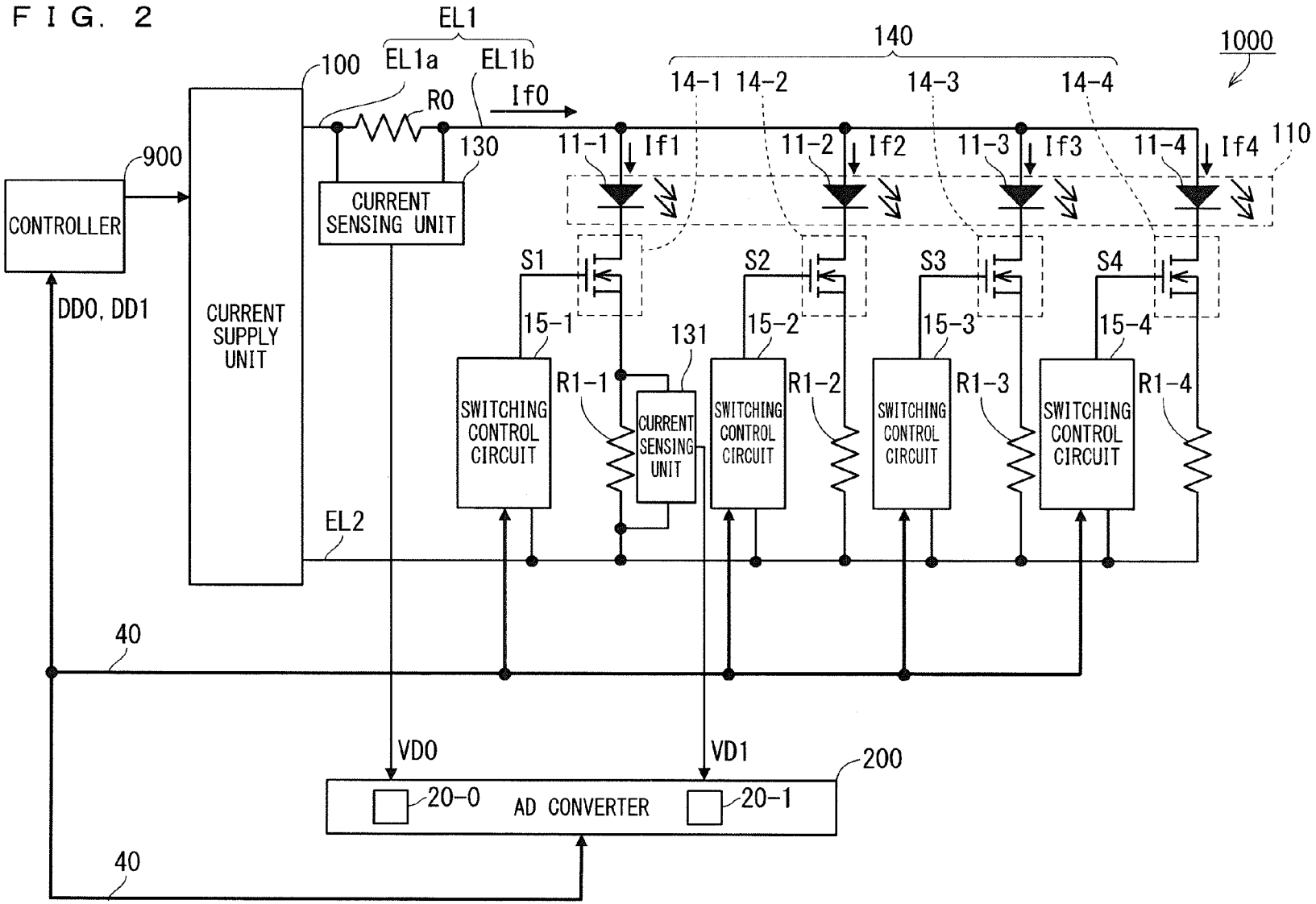
FIG. 2 is a block diagram showing an example of the configuration of the light source control apparatus according to the first preferred embodiment of the present invention.

The light source unit 110 includes light sources 11-1 to 11-*m* (m is a natural number not less than three). The light sources 11-1 to 11-*m* are electrically connected in parallel. Each of the light sources 11-1 to 11-*m* is a light source emitting light of a predetermined color. Hereinafter, each of the light sources 11-1 to 11-*m* is merely referred to as a "light source 11" as well. Specifically, the light source unit 110 includes m light sources 11. When m=4, as shown in FIG. 2, the light source unit 110 includes four light sources 11, namely, the light sources 11-1, 11-2, 11-3, and 11-4. When m=4, the light sources 11-1, 11-2, 11-3, and 11-4 are electrically connected in parallel.

The light source 11 is an LED. In this case, the light source 11 includes two terminals. The light source 11 emits light when supplied with a current. The light source 11 emits, for example, red light. The light source 11 is not limited to an LED and may be, for example, a laser.

The controller 900 controls the current supply unit 100 to control light emission of the light sources 11-1 to 11-*m* connected in parallel. Specifically, the light source control apparatus 1000 controls a plurality of light sources 11 that are connected in parallel.

The light sources 11-1 to 11-*m* are electrically connected at one end to the current supply unit 100. The whole of the light sources 11-1 to 11-*m* is supplied with a drive current If0 from the current supply unit 100. Specifically, the current supply unit 100 collectively supplies a current to a plurality of light sources 11.

Through the light sources 11-1 to 11-*m*, currents If1 to Ifm (m is a natural number not less than three) flow, respectively. When m=4, as shown in FIG. 2, the currents If1, If2, If3, and If4 flow through the light sources 11-1, 11-2, 11-3, and 11-4, respectively. Hereinafter, each of the currents If1 to Ifm is also referred to as a "current Ifn" or "Ifn."

The light sources 11-1 to 11-*m* have the same specifications and the same characteristics. An example of the specifications is a rated current. An example of the specifications is luminance characteristics of the light emitted from the light source 11 in accordance with a supplied current. Another example of the characteristics is forward voltage drop (hereinafter, also referred to as "Vf") in the light emission of the light source 11.

Hereinafter, a low voltage state and a high voltage state are referred to as an "H level" and an "L level," respectively. The H level and the L level are also referred to as "H" and "L," respectively.

The switching unit 140 has a function of stopping the supply of a current to each of the plurality of light sources 11. The switching unit 140 includes switches 14-1 to 14-*m* (m is a natural number not less than three). The switches 14-1 to 14-*m* are electrically connected to the other ends of the light sources 11-1 to 11-*m*, respectively.

When m=4, as shown in FIG. 2, the switching unit 140 includes four switches 14, namely, switches 14-1, 14-2, 14-3, and 14-4. When m=4, the switches 14-1, 14-2, 14-3, and 14-4 are electrically connected to the other ends of the light sources 11-1, 11-2, 11-3, and 11-4, respectively.

Hereinafter, each of the switches 14-1 to 14-*m* is merely referred to as a "switch 14" as well. The switch 14 enters a conductive state (on state) or a non-conductive state (off state) when externally controlled. The switch 14 is controlled when, for example, a short-circuit fault occurs in the light source 11, which is described below in detail. The switch 14 is, for example, a field-effect transistor (FET). The switches 14-1 to 14-*m* have the same specifications and the same characteristics. The switch 14 is not limited to a FET and may be another semiconductor device that can selectively switch between the on state and the off state.

The switches 14-1 to 14-*m* receive control signals S1 to Sm, respectively, which is described below in detail. Hereinafter, each of the control signals S1 to Sm is merely referred to as a "control signal Sn (n is a natural number)." Each switch 14 enters the on state (hereinafter, also referred to as "is turned on") when the level of the received control signal S is the H level. Meanwhile, each switch 14 enters the off state (hereinafter, also referred to as "is turned off") when the level of the received control signal S is the L level.

The sensing resistor R0 is a resistor for sensing the drive current If0 supplied from the current supply unit 100. The sensing resistor R0 is connected at one end to the electric line EL1*a* and is connected at the other end to the electric line EL1*b*.

The sensing resistors R1-1 to R1-*m* are electrically connected at one end to the switches 14-1 to 14-*m* and are connected at the other end to the electric line EL2.

When m=4, as shown in FIG. 2, the sensing resistors R1-1, R1-2, R1-3, and R1-4 are electrically connected at one end to the switches 14-1, 14-2, 14-3, and 14-4, respectively. The sensing resistors R1-1, R1-2, R1-3, and R1-4 are connected at the other end to the electric line EL2.

The sensing resistor R1-1 is a resistor for sensing a current supplied to the light source 11-1 electrically connected to the sensing resistor R1-1 via the switch 14-1. Hereinafter, each of the sensing resistors R1-1 to R1-*m* is merely referred to as a "sensing resistor R1" as well. Each sensing resistor R1 is a resistor for sensing a current supplied to the light source 11 electrically connected to the sensing resistor R1 via the switch 14.

The sensing resistors R1-1 to R1-*m* have the same specifications and the same characteristics. For example, the sensing resistors R1-1 to R1-*m* have the same resistance value. Specifically, the sensing resistors R1-2 to R1-*m* are resistors for causing the current, which has the same current value as the current value of the current flowing through the light source 11-1, to flow through the light sources 11-2 to 11-*m*, respectively. For example, when m=4, the current value of the current flowing through the light source 11-1 is the same as the current values of the currents flowing through the light sources 11-2, 11-3, and 11-4.

The current sensing unit 130 senses the drive current If0 collectively supplied to the plurality of light sources 11 (light sources 11-1 to 11-*m*) by the current supply unit 100. In other words, the current sensing unit 130 is a current sensing circuit having a function of sensing a current. Specifically, the current sensing unit 130 transmits, to the AD converter 200, a current sensing signal VD0 indicative of a voltage level corresponding to the current value of the current (drive current If0) flowing through the sensing resistor R0.

Though described below in detail, it is determined whether the current having a current value set for the current supply unit 100 by the controller 900 is actually supplied to the light source unit 110, on the basis of the digital data, described below, corresponding to the current sensed by the current sensing unit 130.

The current sensing unit 131 is a sensing unit for fault sensing. The current sensing unit 131 senses the current supplied to one of the plurality of light sources 11. Specifically, the current sensing unit 131 senses the current supplied to the light source 11-1. In other words, the current sensing unit 131 is a current sensing circuit having a function of sensing a current. One end of the current sensing unit 131 is electrically connected in parallel to one end of the sensing resistor R1-1. The other end of the current sensing unit 131 is connected to the electric line EL2.

More specifically, the current sensing unit 131 transmits, to the AD converter 200, a current sensing signal VD1 indicative of a voltage level corresponding to the current value of the current flowing through the sensing resistor R1-1. Also, each of the current sensing signals VD0 and VD1 is referred to as a "current sensing signal VDn" or "VDn" as well. Hereinafter, each of the current sensing units 130 and 131 is also referred to as a "current sensing unit DT." In this preferred embodiment, the current sensing units DT included in the light source control apparatus 1000 are fewer than the light sources 11 included in the light source control apparatus 1000. For example, when the light source control apparatus 1000 includes two current sensing units DT, the light source control apparatus 1000 includes three or more light sources 11.

The switching control circuits 15-1 to 15-*m* output control signals S1 to Sm, respectively. The switching control circuits 15-1 to 15-*m* are electrically connected to the switches 14-1 to 14-*m*, respectively. The switching control circuits 15-1 to 15-*m* are connected to the controller 900 through a signal line 40. The signal line 40 is, for example, an IIC bus.

When m=4, as shown in FIG. 2, the switching control circuits 15-1, 15-2, 15-3, and 15-4 are electrically connected to the switches 14-1, 14-2, 14-3, and 14-4, respectively. The switching control circuits 15-1, 15-2, 15-3, and 15-4 are connected to the controller 900 through the signal line 40.

Hereinafter, each of the switching control circuits 15-1 to 15-*m* is merely referred to as a "switching control circuit 15" as well. Each switching control circuit 15 operates in response to an instruction (command) from the controller 900.

Each switching control circuit 15 performs control of turning on or off a switch 14 corresponding to itself. Specifically, each switching control circuit 15 transmits a control signal Sn of the H or L level to a gate terminal of its corresponding switch 14. The control signal Sn is a signal for controlling on/off of the switch 14.

For example, when turning on the switch 14-1, the switching control circuit 15-1 transmits the control signal S1 of the H level to the gate terminal of the switch 14-1. Meanwhile, for example, when turning off the switch 14-1, the switching control circuit 15-1 transmits the control signal S1 of the L level to the gate terminal of the switch 14-1.

The AD converter 200 converts the voltage value (voltage level) of a current sensing signal VDn to digital data (digital value) on the basis of a predetermined rule, which is described below in detail. The AD converter 200 is connected to the controller 900 through the signal line 40. The AD converter 200 transmits the digital data to the controller 900 in response to a request from the controller 900.

The following describes in detail, as an example, the current supplied from the current supply unit 100 when m=4. With reference to FIG. 2, as described above, the currents If1, If2, If3, and If4 flow through the light sources 11-1, 11-2, 11-3, and 11-4, respectively. The relationships expressed in Expressions 1 and 2 are established in the drive current If0 and the currents If1 to If4.

$$If0=If1+If2+If3+If4 \quad \text{(Expression 1)}$$

$$If1=If2=If3=If4 \quad \text{(Expression 2)}$$

The current value of the drive current If0 that is supplied from the current supply unit 100 is assumed to be, for example, 12 amperes (A). In this case, on the basis of Expression 2 (If1=If2=If3=If4=3 A), a current of 3 A flows through each of the light sources 11-1 to 11-4 when the switches 14-1 to 14-4 are each turned on.

The following describes the current sensing units 130 and 131 in detail. The current sensing unit 130 has a function of converting the current (drive current If0) flowing through the sensing resistor R0 to a current sensing signal VD0 of 0 to 5 V in accordance with the characteristics based on Expression 3 below. The current sensing unit 131 has a function of converting the current If1 flowing through the sensing resistor R1-1 to a current sensing signal VD1 of 0 to 5 V in accordance with the characteristics based on Expression 3 below. As described above, each of the current sensing signals VD0 and VD1 is represented as a "current sensing signal VDn" or VDn." Also as descried above, each of the currents If1 and If2 is represented as a "current Ifn" or "Ifn." The current sensing signal VDn (n: 0, 1) is calculated on the basis of Expression 3 below.

$$VDn = Ifn/5 \quad \text{(Expression 3)}$$

In Expression 3, n of VDn and Ifn is 0 or 1.

Figure 3:
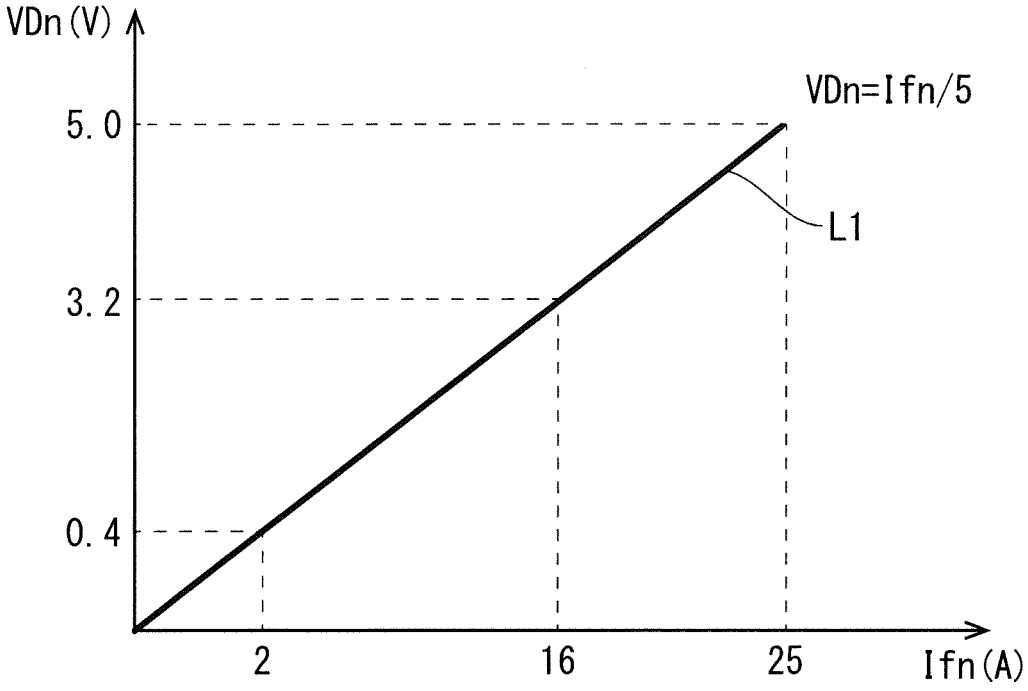
FIG. 3 shows the characteristics of a current sensing unit according to the first preferred embodiment of the present invention.

FIG. 3 shows a characteristic line L1 indicating the characteristics of Expression 3. Specifically, FIG. 3 shows the characteristics of the current sensing unit DT (current sensing units 130 and 131) according to the first preferred embodiment of the present invention.

On the basis of Expression 3, the voltage of the current sensing signal VDn transmitted to the AD converter 200 by the current sensing units 130 and 131 is as follows. In one example, when the current value of the current sensed by the current sensing units 130 and 131 is 0 A, the voltage of the current sensing signal VDn is 0 V. In another example, when the current value of the current sensed by the current sensing units 130 and 131 is 2 A, the voltage of the current sensing signal VDn is 0.4 V. In still another example, when the current value of the current sensed by the current sensing units 130 and 131 is 10 A, the voltage of the current sensing signal VDn is 2.0 V.

The following describes the AD converter 200 in detail. The AD converter 200 includes conversion units 20-0 and 20-1 as channels. The conversion units 20-0 and 20-1 are connected to the current sensing units 130 and 131, respectively.

The conversion unit 20-0 receives a current sensing signal VD0 from the current sensing unit 130. The conversion unit 20-1 receives the current sensing signal VD1 from the current sensing unit 131.

The conversion unit 20-0 converts the received current sensing signal VD0 to digital data DD0. Hereinafter, the digital data DD0 is merely referred to as "DD0" as well. The conversion unit 20-0 converts the received current sensing signal VD1 to digital data DD1. Hereinafter, the digital data DD1 is merely referred to as "DD1" as well. Each of the pieces of digital data DD0 and DD1 is also referred to as "digital data DDn" or "DDn," and each of the conversion units 20-0 and 20-1 is also referred to as a "conversion unit 20."

Specifically, each conversion unit 20 converts the voltage level of a current sensing signal VDn to digital data DDn (n: 0, 1) on the basis of Expression 4 below. The digital data DDn is, for example, data indicative of any value in the range of 0 to 250.

$$DDn = 250 \times (VDn/5) \quad \text{(Expression 4)}$$

In Expression 4, n of DDn and VDn is 0 or 1. On the basis of Expressions 3 and 4, Expression 5 is established.

$$DDn = Ifn \times 10 \quad \text{(Expression 5)}$$

In Expression 5, n of DDn and Ifn is 0 or 1.

The AD converter 200 transmits the digital data DDn to the controller 900 in response to a request from the controller 900.

For the pieces of digital data DD0 and DD1, the relationship of Expression 6 is established on the basis of the relationships of Expressions 1, 2, and 5.

$$DD0 = DD1 \times 4 \quad \text{(Expression 6)}$$

When the relationship of Expression 6 is established for DD0 and DD1, the light sources 11 of the light source control apparatus 1000 (light source unit 110) have no fault, and each of the light sources 11 of the light source unit 110 operates normally. Meanwhile, when the relationship of Expression 6 is not established for DD0 and DD1, any of the light sources 11-1 to 11-4 has a fault.

The following describes an actual operation of the light source control apparatus 1000. First, the controller 900 sets, for the current supply unit 100, the current value of the drive current If0 supplied from the current supply unit 100. Then, the controller 900 controls the switching control circuits 15-1 to 15-4 so as to set the levels of the control signals S1 to S4 transmitted respectively from the switching control circuits 15-1 to 15-4 to the H level. In this manner, the controller 900 controls the switching control circuits 15-1 to 15-4 such that the light sources 11-1 to 11-4 are supplied with the currents If1 to If4, respectively. The controller 900 accordingly causes each light source 11 to light up at a luminance requested by the user. The image display apparatus displays an image using the light emitted from the light source control apparatus 1000.

The controller 900 acquires (observes) the pieces of digital data DD0 and DD1 from the AD converter 200 through the signal line 40 at regular intervals. This allows the controller 900 to measure (calculate) the drive current If0 supplied from the current supply unit 100 and the current If1 flowing through the light source 11-1 as required.

Hereinafter, the current value of an actual drive current If0 based on the value of the digital data DD0 is also referred to as an "actual current value." Also, the current value of the drive current If0, set by the controller 900, is referred to as a "set current value" as well.

The controller 900 monitors whether the actual current value based on the value of the acquired digital data DD0 is equal to the set current value. Hereinafter, a situation in which the actual current value is equal to the set current value is also referred to as a "situation N," and a situation in which the actual current value differs from the set current value is also referred to as a "situation X."

For example, the controller 900 is configured as follows: if the situation X in which an actual current value differs from a set current value occurs due to, for example, variations in the characteristics of the components constituting the current supply unit 100, the controller 900 performs a process N for changing the set current value such that the actual current value is equal to a desired current value. Specifically, the controller 900 operates in accordance with the program for performing the process N.

Now, the operation of the light source control apparatus 1000 on a premise A1 below is below. On the premise A1, the light source control apparatus 1000 has the configuration shown in FIG. 2. Specifically, on the premise A1, the light source unit 110 includes the light sources 11-1, 11-2, 11-3, and 11-4. On the premise A1, the rated current of each of the light sources 11-1 to 11-4 is 4.5 amperes (A). Hereinafter, the rated current of the light source 11 is also referred to as a "rated value."

In this specification, the rated value (rated current) of the light source 11 is a value at which the light source 11 operates (emits light) normally when a current having a current value smaller than or equal to the rated value flows through the light source 11. The rated value (rated current) of the light source 11 is a value at which a fault may occur in the light source 11 when the current having a current value larger than the rated value flows through the light source 11.

On the premise A1, the controller 900 controls the current supply unit 100 to set the current value of the drive current HD to 12 A. Specifically, on the premise A1, the set current value is 12 A. On the premise A1, thus, each of the light sources 11-1 to 11-4 is supplied with a current Ifn of 3 A on the basis of the expression 12/4 that is based on Expressions 1 and 2.

It is assumed here that, for example, the situation N is maintained without variations in the characteristics of the components constituting the current supply unit 100. Substituting the value (Ifn=3) on the premise A1 into Expression 5 yields DD1=10×3=30. Substituting DD1=30 into Expression 6 yields 120 as the value of the digital data DD0. Specifically, in the situation N, the value of the digital data DD0 acquired by the controller 900 is 120.

Hereinafter, a situation in which the value of the digital data DD0 is larger than 120 on the premise A1 is also referred to as an "overcurrent condition." In the overcurrent condition, the current value of the drive current If0 is larger than 12 A. Hereinafter, a situation in which the value of the digital data DD0 is smaller than 120 on the premise A1 is also referred to as an "undercurrent condition." In the undercurrent condition, the current value of the drive current If0 is smaller than 12 A. Hereinafter, the luminance of the light emitted from the light source unit 110, which is desired by the user, is also referred to as a "target luminance."

An example of the overcurrent condition is now described. It is assumed here that the value of the digital data DD0 acquired by the controller 900 is 130. In this case, the controller 900 determines that the current value (actual current value) of the drive current If0 is 13 A on the basis of Expression 5. The controller 900 then controls the current supply unit 100 to set the present set current value to be smaller than the set current value such that the actual current value becomes 12 A (that is, such that DD0 becomes 120).

Next, an example of the undercurrent condition is described. It is assumed here that the value of the digital data DD0 acquired by the controller 900 is 110. In this case, the controller 900 determines that the current value (actual current value) of the drive current If0 is 11 A on the basis of Expression 5. The controller 900 then controls the current supply unit 100 to set the present set current value to be larger than the set current value such that the actual current value becomes 12 A (that is, such that DD0 becomes 120).

As described above, the controller 900 controls the current supply unit 100 so as to acquire a desired luminance desired by the user, thereby controlling an amount of the current to be supplied to the light source unit 110 (light source 11).

The controller 900 monitors whether each of the light sources 11 included in the light source unit 110 operates normally. Specifically, the controller 900 determines whether each of the light sources 11 of the light source unit 110 operates normally on the basis of the values of the pieces of digital data DD0 and DD1.

When all the light sources 11 included in the light source unit 110 operate normally on the premise A1, the current value of the drive current If0 is 12 A, and all the current values of If1, If2, If3, and If4 are 3 A. Hereinafter, the state in which the current values of If1, If2, If3, and If4 are 3 A on the premise A1 is also referred to as a "state STa1."

In this case, on the basis of Expression 5, the pieces of digital data DD0 and DD1 acquired by the controller 900 from the AD converter 200 indicate 120 and 30, respectively. Specifically, when the relationship of Expression 6 is established for DD0 and DD1, the controller 900 determines that each of the light sources 11 of the light source control apparatus 1000 (light source unit 110) operates normally. In this case, the controller 900 causes each of the light sources 11 of the light source unit 110 to continuously light up as a light source for displaying an image.

The accidental faults of the light source 11 include a short-circuit fault and an open-circuit fault. The case in which a short-circuit fault has occurred in the light source 11 is described first. The short-circuit fault is a fault in which two terminals of the light source 11 have been short-circuited. The open-circuit fault is a fault in which two terminals of the light source 11 have been open-circuited.

Hereinafter, a faulty light source 11 that cannot emit light, included in the light source unit 110, is also referred to as a "faulty light source." The faulty light source is a light source 11 in which a short-circuit fault has occurred or a light source 11 in which an open-circuit fault has occurred. Hereinafter, a light source 11 having a short-circuit fault is also referred to as a "short-circuit-fault light source," and a light source 11 having an open-circuit fault is also referred to as an "open-circuit-fault light source." Also, a light source 11 that is not faulty and can normally emit light, included in the light source unit 110, is referred to as a "normal light source" as well. The normal light source is a light source of the plurality of light sources 11 included in the light source unit 110 except for a faulty light source.

Hereinafter, a path for flowing a current for causing the light source 11 to emit light is also referred to as a "current path." For example, the current path for the light source 11-1 is a path for flowing a current for causing the light source 11-1 to emit light. For example, with reference to FIG. 1, the current path for the light source 11-1 is a path extending from the light source 11-1 to the electric line EL2.

Hereinafter, a switch 14 controlled for identifying a short-circuit-fault light source is also referred to as a "short-circuit fault determining switch." For example, short-circuit fault determining switches on the premise A1 are the switches 14-1 to 14-4. Hereinafter, the switch 14 provided in the current path for the short-circuit-fault light source is also referred to as a "short-circuit fault identifying switch." Also, a situation in which switches of the switches 14-1 to **14-*m* included in the switching unit 140, except for a short-circuit fault identifying switch, remain turned on is referred to as a "partially turned-on condition" as well. The short-circuit fault identifying switch is a switch that changes the value of DD1** when only the short-circuit fault identifying switch is turned off in the partially turned-on condition.

For example, a short-circuit fault identifying switch on the premise A1 is a switch that changes the value of DD1 when only the short-circuit fault identifying switch is turned off in the situation in which switches of the switches 14-1 to 14-4 except for the short-circuit fault identifying switch remain turned on.

Now, a process on a premise B1 below involving the premise A1 is described. On the premise B1, the current value of the drive current If0 is 12 A. On the premise B1, the light source 11-1 has a short-circuit fault.

On the premise B1, all of the drive current If0 of 12 A flows through the current path for the light source 11-1. As described above, the current path for the light source 11-1 is the path extending from the light source 11-1 to the electric line EL2. Thus, no current is supplied to the light sources 11-2 to 11-4 being normal light sources. The current values of the currents If1, If3, and If4 are accordingly 0 A. Hereinafter, the state in which the current values of If1, If2, If3, and If4 are 12, 0, 0, and 0 on the premise B1 is also referred to as a "state STb1."

On the premise B1, the current value of the drive current HD sensed by the current sensing unit 130 is 12 A. On the premise B1, all of the drive current If0 of 12 A flows through the current path for the light source 11-1, and thus, the current value of the current If1 sensed by the current sensing unit 131 is 12 A.

On the premise B1, the pieces of digital data DD0 and DD1 acquired by the controller 900 indicate 120, 120, respectively. In this case, the relationship of Expression 6 is not established for DD0 and DD1. The controller 900 accordingly determines that a fault has occurred in any of the light sources 11-1 to 11-4. The controller 900 further determines that a short-circuit fault has occurred in the light source 11-1 on the basis of DD0=DD1=120. The controller 900 then controls the switching control circuit 15-1 to turn off the switch 14-1 provided in the current path for the light source 11-1 in which a short-circuit fault has occurred.

Hereinafter, in the presence of a faulty light source, the current value of a current supplied to one normal light source is referred to as a "fault-existing current value."

In the presence of a faulty light source, the controller 900 performs a current determining process. In the current determining process, for each of the light sources 11, the controller 900 determines whether a current supplied to the normal light sources except for a faulty light source is optimum. Specifically, the controller 900 determines whether the current value (fault-existing current value) of the current supplied to a normal light source is smaller than or equal to a rated value (4.5 A). More specifically, in the current determining process, the controller 900 determines whether the relationship of Expression 7 below is established.

$$(If0/\text{the number of normal light sources}) \leq \text{rated value} \quad \text{(Expression 7)}$$

In Expression 7, the rated value is the rated value (rated current) of one normal light source (light source 11). When the relationship of Expression 7 is established, a drive current changing process described below is not performed.

When the fault-existing current value is larger than the rated value (when the relationship of Expression 7 is not established), the controller 900 performs the drive current changing process for changing (resetting) the drive current If0, which is described below.

On the premise B1 described above, when the switch 14-1 is turned off and the drive current If0 of 12 A is supplied to three light sources 11 being normal light sources, on the basis of 12/3, the current value (fault-existing current value) of the current supplied to each of these light sources 11 is 4 A. In this case, the fault-existing current value (4 A) is smaller than or equal to the rated value (4.5 A), and thus, it is determined that there is no problem. In this case, the drive current changing process is not performed. Specifically, when the relationship of Expression 7 is established, the drive current If0 is not changed.

Next, a process on a premise B2 below involving the premise A1 is described as another example. On the premise B2, the current value of the drive current If0 is 15 A. On the premise B2, no faulty light source is present. In other words, the light sources 11-1 to 11-4 are normal light sources.

On the premise B2, on the basis of 15/4=3.75, a current of 3.75 A smaller than or equal to the rated value (4.5) is supplied to each of the light sources 11-1 to 11-4 being normal light sources, and thus, there is no problem. In this case, the drive current changing process is not performed. Hereinafter, a state in which the current values of If1, If2, If3, and If4 are 3.75, 3.75, 3.75, and 3.75, respectively, on the premise B2 is also referred to as a "state STb2."

Next, a process on a premise B3 below involving the premise A1 is described as still another example. On the premise B3, the current value of the drive current If0 is 15 A. On the premise B3, the light source 11-1 has a short-circuit fault. It is assumed on the premise B3 that the switch 14-1 is turned off.

On the premise B3, on the basis of 15/3=5, a current of 5 A larger than the rated value (4.5) is supplied to each of the light sources 11-2 to 11-4 being normal light sources. This means that, on the premise B3, a further fault may occur if no measure is taken. Hereinafter, a state in which the current values of If1, If2, 113, and If4 are 0, 5, 5, and 5, respectively, on the premise B3 is also referred to as a "state STb3."

In this case, the controller 900 performs the drive current changing process. In the drive current changing process, the controller 900 changes (resets) the set current value of the drive current HO such that the fault-existing current value is smaller than or equal to the rated value. Specifically, the controller 900 controls the current supply unit 100 to change the value of the drive current If0 such that the relationship of Expression 7 is established.

For example, in the drive current changing process on the premise B3, the controller 900 controls the current supply unit 100 to change the set current value 15 A to 13 A. This results in 13/3=4.33, so that a current of 4.33 A smaller than or equal to the rated value (4.5) is supplied to each of the light sources 11-2 to 11-4 being normal light sources. This causes no problem.

The controller 900 performs a switch control process as required after the current determining process. In the switch control process, the controller 900 controls the supply of a current to each light source 11 in accordance with the type of a faulty light source.

Now, a switch control process on the premise B1 is described as an example. In the switch control process on the premise B1, the controller 900 controls the switching control circuit 15-1 to turn off the switch 14-1 provided in the current path for the light source 11-1 in which a short-circuit fault has occurred. Specifically, the controller 900 controls the switching control circuit 15-1 through the signal line 40 so as to change the level of the control signal S1 of the switch 14-1 provided in the current path for the light source 11-1 from "H" to "L."

The switch 14-1 enters the off state so as to interrupt a current after the level of the control signal S1 changes to "L." Thus, no current flows through the current path for the light source 11-1. Consequently, a current of 4 A, obtained by evenly dividing the drive current If0 of 12 A supplied from the current supply unit 100 into three, is evenly supplied to each of the light sources 11-2 to 11-4 being normal light sources.

The current values of the currents If2, If3, and If4 supplied respectively to the light sources 11-2, 11-3, and 11-4 are 4 A on the basis of 12/3=4, which is smaller than or equal to the rated value (4.5). Specifically, the currents If2, If3, and If4 of 4 A are supplied to the light sources 11-2, 11-3, and 11-4, respectively. This causes the light source unit 110 (light sources 11-2, 11-3, and 11-4) to light up normally, enabling the image display apparatus to normally display an image using the light emitted from the light source unit 110.

Next, a process on a premise B4 below involving the premise A1 is described as another example. On the premise B4, the current value of the drive current If0 is 12 A. On the premise B4, the light source 11-3 has a short-circuit fault.

On the premise B4, all of the drive current If0 of 12 A flows through the current path for the light source 11-3. Here, the current path for the light source 11-3 is a path extending from the light source 11-3 to the electric line EL2. The current value of the current If3 is accordingly 12 A. Thus, no current is supplied to the light sources 11-1, 11-2, and 11-4 being normal light sources. The current values of the currents If1, If2, and If4 are accordingly 0 A. Hereinafter, a state in which the current values of If1, If3, and If4 are 0, 0, 12, and 0, respectively, on the premise B4 is also referred to as a "state STb4."

On the premise B4, the current value of the drive current If0 sensed by the current sensing unit 130 is 12 A. On the premise B4, on the basis of Expression 5, the pieces of digital data DD0 and DD1 acquired by the controller 900 indicate 120 and 0, respectively.

In this case, the relationship of Expression 6 is not established for DD0 and DD1. The controller 900 thus determines that a fault has occurred in any of the light sources 11-1 to 11-4. The controller 900 further performs a sequentially-turning-off control process T for identifying a faulty light source (short-circuit-fault light source) having a short-circuit fault. In the sequentially-turning-off control process T, the switches 14-1 to 14-4 are sequentially turned off and then turned on, whereby only a single switch is always turned off.

Specifically, in the sequentially-turning-off control process T, the controller 900 controls the switching control circuits 15-1 to 15-4 in such a way that the switches 14-1 to 14-4 being short-circuit fault determining switches are sequentially turned off, whereby only a single switch is always turned off.

Specifically, in the sequentially-turning-off control process T, the controller 900 first controls the switching control circuit 15-1 such that only the switch 14-1 is turned off, with the switches 14-2, 14-3, and 14-4 remaining turned on. On the premise B4, even if the switch 14-1 is turned off, no current originally flows through the light source 11-1. The values of DD0 and DD1 accordingly do not change. The controller 900 then controls the switching control circuit 15-1 such that the switch 14-1 is turned on.

Then, the controller 900 controls the switching control circuit 15-2 such that only the switch 14-2 is turned off, with the switches 14-1, 14-3, and 14-4 remaining turned on. On the premise B4, even if the switch 14-2 is turned off, no current originally flows through the light source 11-2. The values of DD0 and DD1 accordingly do not change. The controller 900 then controls the switching control circuit 15-2 such that the switch 14-2 is turned on.

Then, the controller 900 controls the switching control circuit 15-3 such that only the switch 14-3 is turned off, with the switches 14-1, 14-2, and 14-4 remaining turned on. In the situation in which the switch 14-3 is turned off, no current flows through the light source 11-3 having a short-circuit fault. Thus, a current of 4 A, obtained by evenly dividing a drive current If0 of 12 A into three, flows through each of the light sources 11-1, 11-2, and 11-4. In this case, the current values of the currents If1, IC, and If4 are 4 A. The light sources 11-1, 11-2, and 11-4 accordingly light up. This enables the image display apparatus to normally display an image using the light emitted from the light source unit 110.

In the partially turned-on condition, if only the switch 14-3 is turned off, DD0 and DD1 indicate 120 and 40, respectively, on the basis of Expression 5. In other words, the value of DD1 changes. The short-circuit fault identifying switch is accordingly the switch 14-3. When the switch 14-3 provided in the current path for the short-circuit-fault light source is a short-circuit fault identifying switch, the short-circuit-fault light source is the light source 11-3. As a result, the controller 900 identifies the light source 11-3 as a short-circuit-fault light source.

The controller 900 identifies the current value (fault-existing current value) of the current, supplied to each of the light sources 11-1, 11-2, and 11-4 being normal light sources except for the light source 11-3, as 4 A. The fault-existing current value is smaller than or equal to the rated value (4.5 A), and thus, the controller 900 does not perform the drive current changing process. This allows the light sources 11-1, 11-2, and 11-4 to continuously light up without any change. This enables the image display apparatus to normally display an image using the light emitted from the light source unit 110.

The following describes a case in which an open-circuit fault has occurred in the light source 11. Described here is a process on a premise C1 below involving the premise A1. On the premise C1, the current value of the drive current NO is 12 A. On the premise C1, the light source 11-1 has an open-circuit fault.

On the premise C1, no current flows through the current path for the light source 11-1 at all. Meanwhile, a current of 4 A, obtained by evenly dividing the drive current If0 of 12 A into three, flows through each of the light sources 11-2, 11-3, and 11-4. The current values of the currents If2, If3, and If4 are accordingly 4 A. Hereinafter, a state in which the current values of If1, If2, If3, and If4 are 0, 4, 4, and 4, respectively, on the premise C1 is also referred to as a "state STc1."

On the premise C1, the current value of the drive current If0 sensed by the current sensing unit 130 is 12 A. On the premise C1, as described above, no current flows through the current path for the light source 11-1 at all, and thus, the current value of the current If1 sensed by the current sensing unit 131 is 0 A.

On the premise C1, on the basis of Expression 5, the pieces of digital data DD0 and DD1 acquired by the controller 900 indicate 120 and 0, respectively. In this case, the relationship of Expression 6 is not established for DD0 and DD1. The controller 900 accordingly determines that a fault has occurred in any of the light sources 11-1 to 11-4.

The controller 900 further performs a sequentially-turning-off control process K for identifying a faulty light source (open-circuit-fault light source) having an open-circuit fault. In the sequentially-turning-off control process K, the switches 14-1 to 14-4 are sequentially turned off and then turned on, whereby only a single switch is always turned off.

Even when each switch 14 is turned off in the sequentially-turning-off control process K, an open-circuit-fault light source is present if the values of DD0 and DD1 do not change even once. This open-circuit-fault light source is the light source 11-1.

Meanwhile, in the cases where the values of DD0 and DD1 change and where the values of DD0 and DD1 do not change by sequentially turning off the switches 14 in the sequentially-turning-off control process K, an open-circuit-fault light source is present. This open-circuit-fault light source is a light source 11 located in the current path for the light source 11, which includes the switch 14 that does not change the values of DD0 and DD1 even after being turned off.

Specifically, in the sequentially-turning-off control process K, the controller 900 controls the switching control circuits 15-1 to 15-4 in such a way that the switches 14-1 to 14-4 are sequentially turned off, where only a single switch is always turned off.

Specifically, in the sequentially-turning-off control process K, the controller 900 first controls the switching control circuit 15-1 such that only the switch 14-1 is turned off, with the switches 14-2, 14-3, and 14-4 remaining turned on. Even if the switch 14-1 is turned off, on the premise C1, no current originally flows through the light source 11-1. The values of DD0 and DD1 accordingly do not change. The controller 900 then controls the switching control circuit 15-1 such that the switch 14-1 is turned on.

The controller 900 then controls the switching control circuit 15-2 such that only the switch 14-2 is turned off, with the switches 14-1, 14-3, and 14-4 remaining turned on. Even if the switch 14-2 is turned off, on the premise C1, no current originally flows through the light source 11-2. The values of DD0 and DD1 accordingly do not change. The controller 900 then controls the switching control circuit 15-2 such that the switch 14-2 is turned on.

The controller 900 then controls the switching control circuit 15-3 such that only the switch 14-3 is turned off, with the switches 14-1, 14-2, and 14-4 remaining turned on. Also in this case, the values of DD0 and DD1 do not change on the premise C1. The controller 900 then controls the switching control circuit 15-3 such that the switch 14-3 is turned on.

The controller 900 then controls the switching control circuit 15-4 such that only the switch 14-4 is turned off in the situation, with the switches 14-1, 14-2, and 14-3 remaining turned on. Also in this case, on the premise C1, the values of DD0 and DD1 do not change. The controller 900 then controls the switching control circuit 15-4 such that the switch 14-4 is turned on.

As described above, also in the case where each switch 14 is turned off in the sequentially-turning-off control process K, an open-circuit-fault light source is present if the values of DD0 and DD1 do not change even once. This open-circuit-fault light source is the light source 11-1. The controller 900 accordingly identifies the light source 11-1 as an open-circuit-fault light source.

On the premise C1, the controller 900 identifies the current value (fault-existing current value) of the current, supplied to each of the light sources 11-2, 11-3, and 11-4 being normal light sources except for the light source 11-1, as 4 A. The fault-existing current value is smaller than or equal to the rated value (4.5 A), and thus, the controller 900 does not perform the drive current changing process without any change. This allows the light sources 11-2, 11-3, and 11-4 to continuously light up. This enables the image display apparatus to normally display an image using the light emitted from the light source unit 110.

The following describes a process on a premise C2 below involving the premise A1 as an another example. On the premise C2, the current value of the drive current If0 is 12 A. On the premise C2, the light source 11-4 has an open-circuit fault.

On the premise C2, no current flows through the current path for the light source 11-4 at all. The current value of the current If4 is accordingly 0 A. Meanwhile, a current of 4 A, obtained by evenly dividing a drive current HD of 12 A into three, flows through each of the light sources 11-1, 11-2, and 11-3. The current values of the currents If1, If2, and If3 are accordingly 4 A.

On the premise C2, the current value of the drive current If0 sensed by the current sensing unit 130 is 12 A. On the premise C2, the current value of the current If1 sensed by the current sensing unit 131 is 4 A. Hereinafter, a state in which the current values of If1, If2, If3, and If4 are 4, 4, 4, and 0, respectively, on the premise C2 is also referred to as a "state STc2."

On the premise C2, on the basis of Expression 5, the pieces of digital data DD0 and DD1 acquired by the controller 900 indicate 120 and 40, respectively. In this case, the relationship of Expression 6 is not established for DD0 and DD1. The controller 900 accordingly determines that a fault has occurred in any of the light sources 11-1 to 11-4.

The controller 900 further performs the sequentially-turning-off control process K for identifying a faulty light source (open-circuit-fault light source) having an open-circuit fault.

In the sequentially-turning-off control process K, as described above, the controller 900 first controls the switching control circuit 15-1 such that only the switch 14-1 is turned off, with the switches 14-2, 14-3, and 14-4 remaining turned on. Thus, no current flows through the current path for the light source 11-1.

On the premise C2, the current value of the drive current If0 sensed by the current sensing unit 130 is 12 A. When only the switch 14-1 is turned off on the premise C2, no current flows through the current path for the light source 11-1, and thus, the current value of the current If1 sensed by the current sensing unit 131 changes from 4 A to 0 A. Thus, DD0 keeps 120 and, on the basis of Expression 5, DD1 becomes 0. The controller 900 then controls the switching control circuit 15-1 such that the switch 14-1 is turned on.

The controller 900 then controls the switching control circuit 15-2 such that only the switch 14-2 is turned off, with the switches 14-1, 14-3, and 14-4 remaining turned on. Thus, no current flows through the light source 11-4 being an open-circuit-fault light source, and besides, through the light source 11-2. A current of 6 A, obtained by dividing a drive current If0 of 12 A into two, flows through each of the light sources 11-1 and 11-3. In other words, the current values of the currents If1 and If3 are 6 A. Thus, DD0 remains 120 and, on the basis of Expression 5, DD1 becomes 60. The controller 900 then controls the switching control circuit 15-2 such that the switch 14-2 is turned on.

The controller 900 then controls the switching control circuit 15-3 such that only the switch 14-3 is turned off, with the switches 14-1, 14-2, and 14-4 remaining turned on. Thus, no current flows through the light source 11-4 being an open-circuit-fault light source, and besides, through the light source 11-3. A current of 6 A, obtained by dividing a drive current If0 of 12 A into two, flows through each of the light sources 11-1 and 11-2. In other words, the current values of the currents If1 and If2 are 6 A. Thus, DD0 remains 120 and, on the basis of Expression 5, DD1 becomes 60. The controller 900 then controls the switching control circuit 15-3 such that the switch 14-3 is turned on.

The controller 900 then controls the switching control circuit 15-4 such that only the switch 14-4 is turned off, with the switches 14-1, 14-2, and 14-3 remaining turned on. Even if the switch 14-4 is turned off, on the premise C2, no current originally flows through the light source 11-4. The currents If1, If2, In, and If4 accordingly do not change. Specifically, the current values of the currents If1, If2, and If3 are 4 A, and the current value of the current If4 is 0 A.

On the premise C2, the current value of the drive current If0 sensed by the current sensing unit 130 is 12 A. On the premise C2, the current value of the current If1 sensed by the current sensing unit 131 is 4 A.

The pieces of digital data DD0 and DD1 acquired by the controller 900 on the premise C2 indicate 120 and 40, respectively, on the basis of Expression 5. The controller 900 then controls the switching control circuit 15-4 such that the switch 14-4 is turned on.

As described above, in the cases where the values of DD0 and DD1 change and where the values of DD0 and DD1 do not change by sequentially turning off the switches 14 in the sequentially-turning-off control process K, an open-circuit-fault light source is present. This open-circuit-fault light source is a light source 11 located in the current path for the light source 11, which includes the switch 14 that does not change the values of DD0 and DD1 even after being turned off. On the premise C2, the switch that does not change the values of DD0 and DD1 is the switch 14-4. The open-circuit-fault light source is accordingly a light source 11-4 located in the current path for the light source 11-4, which includes the switch 14-4. The controller 900 accordingly identifies the light source 11-4 as an open-circuit-fault light source.

The controller 900 identifies the current value (fault-existing current value) of a current, supplied to each of the light sources 11-1, 11-2, and 11-3 being normal light sources except for the light source 11-4, as 4 A. The fault-existing current value is smaller than or equal to the rated value (4.5 A), and thus, the controller 900 does not perform the drive current changing process. This allows the light sources 11-1, 11-2, and 11-3 to continuously light up without any change. This enables the image display apparatus to normally display an image using the light emitted from the light source unit 110.

Figure 4:
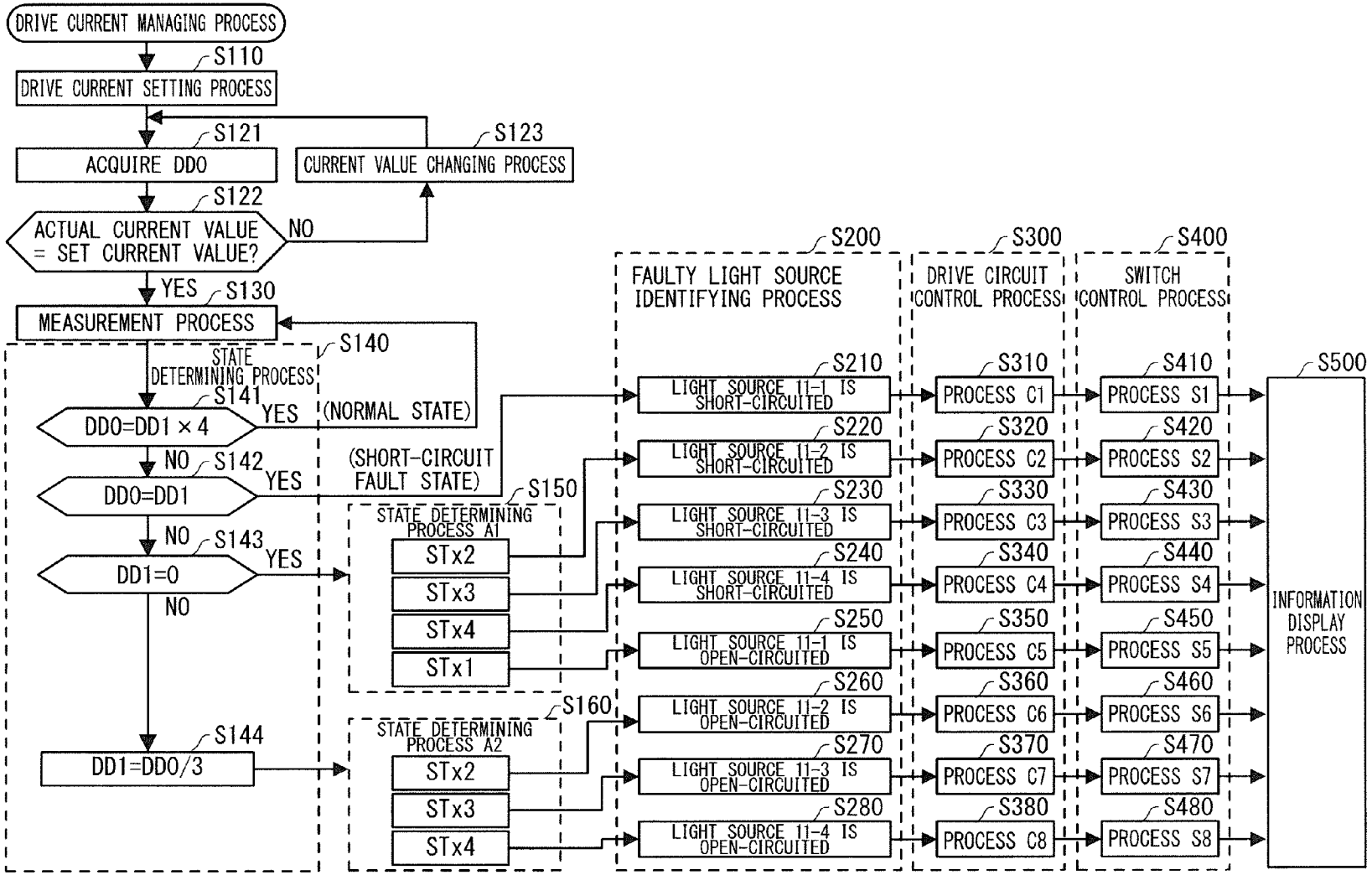
FIG. 4 is a flowchart of a drive current managing process.

The following describes a process (hereinafter, also referred to as a drive current managing process) for the controller 900 to perform the process described above. FIG. 4 is a flowchart of the drive current managing process. The following describes the drive current managing process on a premise D1.

On the premise D1, the light source control apparatus 1000 has the configuration shown in FIG. 2. Specifically, on the premise D1, the light source unit 110 includes light sources 11-1, 11-2, 11-3, and 11-4. On the premise D1, the rated value (rated current) of each of the light sources 11-1 to 11-4 is 4.5 A.

In the drive current managing process, first, a process of Step S110 is performed. Hereinafter, a current value of the drive current If0 desired by the user to obtain the target luminance is also referred to as a "desired current value."

In Step S110, a drive current setting process is performed. In the drive current setting process, the controller 900 sets, for the current supply unit 100, a current value of the drive current If0 to be supplied from the current supply unit 100. Specifically, the controller 900 controls the current supply unit 100 to set the current value of the drive current If0 to a desired current value. As described above, the current value of the drive current If0 set to the desired current value is also referred to as a "set current value." This allows the current supply unit 100 to supply the drive current HD of the set current value (desired current value) to the light source unit 110.

Then, a process of Step S121 described below is performed such that the actual current value is equal to the set current value as described above. In Step S121, DD0 is acquired. Specifically, the controller 900 acquires (reads) the latest digital data DD0 from the AD converter 200.

It is determined in Step S122 whether the actual current value is equal to the set current value. Specifically, the controller 900 determines whether the relationship of Expression 5, that is, DD0=If0×10 is established. If it is determined YES in Step S122, the process moves to Step S130. If it is determined NO in Step S122, meanwhile, the process moves to Step S123.

In Step S123, a current value changing process is performed. In the current value changing process, when the actual current value is larger than the set current value, the controller 900 controls the current supply unit 100 to set a present set current value to be smaller than the set current value such that the present actual current value becomes smaller. For example, the present set current value is set to 0.9 times the present value.

When the actual current value is smaller than the set current value, meanwhile, the controller 900 controls the current supply unit 100 to set a present set current value to be larger than the set current value such that the present actual current value becomes larger. For example, the present set current value is set to 1.1 times the present value. Then, the process of Step S121 is performed again. The processes of Steps S121 and S123 are repeated until it is determined YES in Step S122. The actual current value is accordingly controlled to be equal to the set current value.

In Step S130, a measurement process is performed. In the measurement process, the controller 900 acquires (reads) the latest pieces of digital data DD0 and DD1 from the AD converter 200.

Hereinafter, a state in which the light sources 11-1 to **11-*m* include no faulty light source is also referred to as a "normal state." Specifically, the normal state refers to a state in which the light source unit 110 includes no faulty light source. The normal state is a state in which the current values of the currents If1 to Ifm are larger than zero and smaller than or equal to the rated value (4.5) of each light source 11. The normal state is, for example, the state STa or STb2**.

Hereinafter, a state in which the light sources 11-1 to **11-*m* include a short-circuit-fault light source is also referred to as a "short-circuit fault state." The short-circuit fault state is, for example, the state STb1, STb3, or STb4. Hereinafter, a state in which the light sources 11-1 to 11-*m* include an open-circuit-fault light source is also referred to as an "open-circuit fault state." The open-circuit fault state is, for example, the state STc1 or STc2**.

In Step S140, a state determining process is performed. In the state determining process, the controller 900 determines whether a faulty light source is present on the basis of the pieces of digital data DD0 and DD1. Specifically, in the state determining process, the controller 900 determines, on the basis of the values indicated in the digital data DD0 and DD1, whether the state of the light source unit 110 is the normal state, the short-circuit fault state, or the open-circuit fault state.

The digital data DD0 is the data based on the current value of the drive current If0 sensed by the current sensing unit 130. The digital data DD1 is the data based on the current value of the current If1 sensed by the current sensing unit 131. Specifically, in the state determining process, the controller 900 determines whether a plurality of light sources 11 included in the light source unit 110 include a faulty light source on the basis of the drive current If0 sensed by the current sensing unit 130 and the current If1 sensed by the current sensing unit 131. In other words, the state determining process is a process of determining whether a plurality of light sources 11 included in the light source unit 110 include a faulty light source on the basis of the drive current If0 sensed by the current sensing unit 130 and the current If1 sensed by the current sensing unit 131.

In the state determining process, first, the process of Step S141 is performed. In Step S141, the controller 900 determines whether the relationship of Expression 6 (DD0=DD1×4) is established for DD0 and DD1. When the relationship of DD0=DD1×4 is established for DD0 and DD1 (in the case of YES in S141), the controller 900 determines that the state of the light source unit 110 is the normal state. In this case, the process moves to Step S130 again.

When the relationship of DD0=DD1×4 is not established for DD0 and DD1 (in the case of NO in S141), meanwhile, the controller 900 determines that the state of the light source unit 110 is the short-circuit fault state or the open-circuit fault state. Specifically, when the relationship of DD0=DD1×4 is not established, the controller 900 determines that a faulty light source is present. In this case, the process moves to Step S142.

In Step S142, the controller 900 determines whether the relationship of DD0=DD1 is established for DD0 and DD1. When the relationship of DD0=DD1 is established, the controller 900 determines that the state of the light source unit 110 is the short-circuit fault state. In other words, the controller 900 determines that a short-circuit-fault light source is present.

If it is determined YES in Step S142, the process moves to Step S200. If it is determined NO in Step S142, meanwhile, the process moves to Step S143 described below.

In Step S200, a faulty light source identifying process is performed. In the faulty light source identifying process, the controller 900 identifies a faulty light source on the basis of the pieces of digital data DD0 and DD1. As described above, the digital data DD0 is the data based on the current value of the drive current If0 sensed by the current sensing unit 130. The digital data DD1 is the data based on the current value of the current If1 sensed by the current sensing unit 131. Specifically, in the faulty light source identifying process, the controller 900 identifies a faulty light source on the basis of the drive current If0 and the current If1.

The faulty light source identifying process includes Steps S210, S220, S230, S240, S250, S260, S270, and S280. In each of Steps S210, S220, S230, and S240, the controller 900 identifies a short-circuit-fault light source on the basis of the drive current If0 and the current If1, which is described below. In each of Steps S250, S260, S270, and S280, the controller 900 identifies an open-circuit-fault light source on the basis of the drive current If0 and the current If1.

If it is determined YES in Step S142 above, the process moves to Step S210.

In Step S210, the relationship of DD0=DD1 is established for DD0 and DD1, and thus, as in the process on the premise B1 above, the controller 900 determines that the light source 11-1 has a short-circuit fault. Specifically, the controller 900 determines that a short-circuit-fault light source is the light source 11-1. Then, the process moves to Step S300.

In Step S300, a drive current control process is performed. The drive current control process is a process for the controller 900 to optimize (control) a drive current in the presence of a faulty light source.

The drive current control process includes Steps S310, S320, S330, S340, S350, S360, S370, and S380. After the process of Step S210 above, the process moves to Step S310.

In Step S310, a process C1 is performed. In the process C1, the controller 900 performs the current determining process. The current determining process determines whether the relationship of Expression 7 is established, as described above. When the relationship of Expression 7 is established, the process C1 is completed, and then, the process moves to Step S400.

When the relationship of Expression 7 is not established, meanwhile, the drive current changing process is performed. In the drive current changing process, the controller 900 controls the current supply unit 100 such that the current supply unit 100 performs a process for setting the current value of a current to be supplied to one or more normal light sources to be smaller than or equal to the rated value of the normal light source. Specifically, in the drive current changing process, the controller 900 controls the current supply unit 100 to change the value of the drive current If0 such that the relationship of Expression 7 is established.

Now, a drive current changing process on a premise E1 below involving the premise D1 is described. On the premise E1, the light source 11-1 has a short-circuit fault. It is assumed on the premise E1 that the switch 14-1 is turned off. On the premise E1, the current value of the drive current If0 is 15 A. In other words, on the premise E1, on the basis of 15/3=5, a current of 5 A larger than the rated value (4.5) is to be supplied to each of the light sources 11-2 to 11-4 being normal light sources.

In the drive current changing process on the premise E1, as in the drive current changing process on the premise B3, the controller 900 controls the current supply unit 100 to change the set current value from 15 A to 13 A. In other words, the current supply unit 100 changes the set current value from 15 A to 13 A in accordance with the control from the controller 900 such that the relationship of Expression 7 is established. Specifically, the current supply unit 100 performs a process for setting the current value of a current to be supplied to each of the light sources 11-2 to 11-4, being normal light sources, to be smaller than or equal to the rated value (4.5) of the normal light source.

Consequently, the current supply unit 100 supplies a drive current If0 of 13 A to the whole of the light sources 11-2 to 11-4 if the switch 14-1 is turned off. Here, the relationship of Expression 7 is established, because 13/3=4.33. If the switch 14-1 is turned off, accordingly, a current of 4.33 A smaller than or equal to the rated value (4.5) of the normal light source is to be supplied to each of the light sources 11-2 to 11-4 being normal light sources.

In the process C1 performed in the presence of a faulty light source, therefore, the controller 900 controls the current supply unit 100 when the relationship of Expression 7 is not established or does not control the current supply unit 100 when the relationship of Expression 7 is established.

In Step S400, the switch control process is performed. In the switch control process, in the presence of a short-circuit-fault light source, the controller 900 controls, by controlling (via) the switching control circuit 15, a switching unit 140 such that the switching unit 140 stops the supply of a current to the short-circuit-fault light source.

The switch control process includes Steps S410, S420, S430, S440, S450, S460, S470, and S480. In each of Steps S410, S420, S430, and S440, the controller 900 controls, by controlling (via) the switching control circuit 15, a switching unit 140 such that the switching unit 140 stops the supply of a current to the short-circuit-fault light source, which is described below in detail.

After the process of Step S310 above, the process moves to Step S410.

In Step S410, a process S1 is performed. In the process S1, a process similar to the switch control process on the premise B1 is performed. First, the controller 900 controls the switching control circuit 15 to control a switching unit 140 such that a switch 14-1 of the switching unit 140 stops the supply of a current to the light source 11-1 being a short-circuit-fault light source. Specifically, the controller 900 controls the switching control circuit 15-1 to turn off the switch 14-1 such that the switch 14-1 of the switching unit 140 stops the supply of a current to the light source 11-1 being a short-circuit-fault light source.

More specifically, the controller 900 controls the switching control circuit 15-1 through the signal line 40 so as to change the level of the control signal S1 of the switch 14-1 provided in the current path for the light source 11-1 from "H" to "L." Thus, for example, when the drive current changing process on the premise E1 is performed, a current of 4.33 A, obtained by evenly dividing the drive current HD of 13 A into three, is evenly supplied to each of the light sources 11-2 to 11-4 being normal light sources. This causes the light sources 11-2 to 11-4 to light up.

Consequently, a current supply to the short-circuit-fault light source is stopped, and the current supply unit 100 continuously supplies a current to the light sources 11-2 to 11-4 being normal light sources. Specifically, in the presence of a short-circuit-fault light source, Steps S310 and S410 are performed, so that the controller 900 performs a process N1 below.

In the process N1, when the relationship of Expression 7 is not established, the controller 900 controls the current supply unit 100 and the switching unit 140 such that a current is continuously supplied to normal light sources. In the process N1, meanwhile, when the relationship of Expression 7 is established, the controller 900 controls the switching unit 140 as described above such that a current is continuously supplied to normal light sources. Specifically, in the presence of a faulty light source (short-circuit-fault light source), the controller 900 controls at least one of the current supply unit 100 and the switching unit 140 such that a current is continuously supplied to normal light sources.

Consequently, the switching unit 140 stops a current supply to the short-circuit-fault light source, and the current supply unit 100 continuously supplies a current to the normal light sources.

The light source unit 110 (light sources 11-2, 11-3, and 11-4) is therefore used as a light source for the image display apparatus to display an image.

After the process of Step S410, Step S500 is performed. In Step S500, an information display process is performed. In the information display process, the controller 900 controls the image display apparatus to display the information on a faulty light source 11 (hereinafter, also referred to as "faulty light source information").

Consequently, the image display apparatus displays the faulty light source information by the on-screen display (OSD) function. The faulty light source information is, for example, a message for reporting a light source in which a fault has occurred and encouraging the replacement of the faulty light source 11. This allows the user to easily recognize a faulty light source 11 in which a fault has occurred.

The following describes a process in the case of NO in Step S142 above. As described above, the process moves to Step S143 if it is determined NO in Step S142.

In Step S143, the controller 900 determines whether DD1=0. When DD1=0, the controller 900 determines that the state of the light source unit 110 is the short-circuit fault state or the open-circuit fault state. When it is determined YES in Step S143, the process moves to Step S150. If it is determined NO in Step S143, meanwhile, the process moves to Step S144 below.

In Step S150, a state determining process A1 is performed. In the state determining process A1, the controller 900 determines whether the state of the light source unit 110 is the short-circuit fault state or the open-circuit fault state on the basis of the values indicated in the pieces of digital data DD0 and DD1. In the state determining process A1, the controller 900 performs a sequentially-turning-off control process X. The sequentially-turning-off control process X is the same as the sequentially-turning-off control process T or the sequentially-turning-off control process K. The sequentially-turning-off control processes T and K have been descried in detail, and accordingly, the sequentially-turning-off control process X is not described below in detail.

In the sequentially-turning-off control process X, as in the sequentially-turning-off control processes T and K, the switches 14-1 to 14-4 are sequentially turned off and then turned on, whereby only a single switch is always turned off.

The controller 900 determines whether the relationship of Expression 8 below is established every time each switch 14 is turned off in the sequentially-turning-off control process X.

$$DD1=DD0/3 \quad \text{(Expression 8)}$$

Hereinafter, a state in which the relationship of Expression 8 is established when the switches 14-1, 14-3, and 14-4 are turned on and the switch 14-2 is turned off is also referred to as a "state STx2." Also, a state in which the relationship of Expression 8 is established when the switches 14-1, 14-2, and 14-4 are turned on and the switch 14-3 is turned off is referred to as a "state STx3" as well. Also, a state in which the relationship of Expression 8 is established when the switches 14-1, 14-2, and 14-3 are turned on and the switch 14-4 is turned off is referred to as a "state STx4" as well.

When DD1=0, in each of the states STx2, STx3, and STx4, any of the light sources 11-2, 11-3, and 11-4, provided in the current path including the switch 14 turned off in the sequentially-turning-off control process X, is a short-circuit-fault light source. For example, in the state STx2, the light source 11-2, provided in the current path including the switch 14-2 turned off in the sequentially-turning-off control process X, is a short-circuit-fault light source. For example, in the state STx4, the light source 11-4, provided in the current path including the switch 14-4 turned off in the sequentially-turning-off control process X, is a short-circuit-fault light source.

Hereinafter, a state in which DD1=0 is maintained and the relationship of Expression 8 is not established even when the switches 14-1 to 14-4 are sequentially turned off in the sequentially-turning-off control process X is also referred to as a "state STx1." Specifically, in the state STx1, the values of DD0 and DD1 do not change even when the switches 14-1 to 14-4 are sequentially turned off.

In the state determining process A1, any of the states STx2, STx3, STx4, and STx1 occurs when any of the switches 14-1 to 14-4 is turned off in the sequentially-turning-off control process X.

At the occurrence of the state STx2 in the state determining process A1, the process moves to Step S220 included in the faulty light source identifying process (S200), with the switch 14-2 remaining turned off. It is assumed here that, as an example, the current value of the drive current If0 is 12 A and DD0=120. In this case, in the state STx2, the current values of If1, If2, If3, and If4 are 4, 0, 4, and 4, respectively. DD0 and DD1 are 40 and 120, respectively.

In Step S220, DD1=0 and the relationship of Expression 8 is established in the state STx2, and thus, the controller 900 determines that the light source 11-2 has a short-circuit fault. Specifically, the controller 900 determines that a short-circuit-fault light source is the light source 11-2. The controller 900 also determines that the state of the light source unit 110 is the short-circuit fault state. The process then moves to Step S320 included in the drive current control process (S300).

In Step S320, a process C2 is performed. The process C2 is the same as the process C1, and accordingly, is not described below in detail. The process then moves to Step S420 included in the switch control process (S400).

In Step S420, a process S2 is performed. In the process S2, the controller 900 controls, by controlling (via) the switching control circuit 15, the switching unit 140 such that the switch 14-2 remains turned off. In this case, the light sources 11-1, 11-3, and 11-4 light up, and the light sources 11-1, 11-3, and 11-4 are used as the light sources for the image display apparatus to display an image. Then, after the process of Step S420, Step S500 above is performed.

At the occurrence of the state STx3 in the state determining process A1, the process moves to Step S230 included in the faulty light source identifying process (S200), with the switch 14-3 remaining turned off. The state STx3 in the state determining process A1 is the same as the state STb4 above. In the state STx3, thus, DD0 and DD1 are 40 and 120, respectively.

In Step S230, DD1=0 and the relationship of Expression 8 is established in the state STx3, and thus, the controller 900 determines that the light source 11-3 has a short-circuit fault. Specifically, the controller 900 determines that a short-circuit-fault light source is the light source 11-3. The controller 900 also determines that the state of the light source unit 110 is the short-circuit fault state. The process then moves to Step S330 included in the drive current control process (S300).

In Step S330, a process C3 is performed. The process C3 is the same as the process C1, and thus, is not described below in detail. The process then moves to Step S430 included in the switch control process (S400).

In Step S430, a process S3 is performed. In the process S3, the controller 900 controls, by controlling (via) the switching control circuit 15, the switching unit 140 such that the switch 14-3 remains turned off. In this case, the light sources 11-1, 11-2, and 11-4 light up, and the light sources 11-1, 11-2, and 11-4 are used as the light sources for the image display apparatus to display an image. After the process of Step S430, then, Step S500 above is performed.

At the occurrence of the state STx4 in the state determining process A1, the process moves to Step S240 included in the faulty light source identifying process (S200), with the switch 14-4 remaining turned off.

In Step S240, DD1=0 and the relationship of Expression 8 is established in the state STx4, and thus, the controller 900 determines that the light source 11-4 has a short-circuit fault. Specifically, the controller 900 determines that a short-circuit-fault light source is the light source 11-4. The controller 900 also determines that the state of the light source unit 110 is the short-circuit fault state. The process then moves to Step S340 included in the drive current control process (S300).

In Step S340, a process C4 is performed. The process C4 is the same as the process C1, and thus, is not described below in detail. The process then moves to Step S440 included in the switch control process (S400).

In Step S440, a process S4 is performed. In the process S4, the controller 900 controls, by controlling (via) the switching control circuit 15, the switching unit 140 such that the switch 14-4 remains turned off. In this case, the light sources 11-1, 11-2, and 11-3 light up, and the light sources 11-1, 11-2, and 11-3 are used as the light sources for the image display apparatus to display an image. After the process of Step S440, then, Step S500 above is performed.

At the occurrence of the state STx1 in the state determining process A1, the process moves to Step S250 included in the faulty light source identifying process (S200). In the state STx1, as described above, DD1=0 is maintained and the relationship of Expression 8 is not established even when the switches 14-1 to 14-4 are sequentially turned off. Specifically, in the state STx1, the values of DD0 and DD1 do not change even when the switches 14-1 to 14-4 are sequentially turned off. In the state STx1, an open-circuit-fault light source is present, and the open-circuit-fault light source is the light source 11-1.

In Step S250, DD1=0 is maintained and the relationship of Expression 8 is not established even when the switches 14-1 to 14-4 are sequentially turned off. The controller 900 accordingly determines that the light source 11-1 has an open-circuit fault, as in the determination in the sequentially-turning-off control process K. Specifically, the controller 900 determines that an open-circuit-fault light source is the light source 11-1. The controller 900 also determines that the state of the light source unit 110 is the open-circuit fault state. The process then moves to Step S350 included in the drive current control process (S300).

In Step S350, a process C5 is performed. The process C5 is the same as the process C1, and thus, is not described below in detail. The process C5 is briefly described below. In the process C5, when the relationship of Expression 7 is established, the process C5 is completed. The process then moves to Step S450 included in the switch control process (S400).

In the process C5, meanwhile, when the relationship of Expression 7 is not established, the drive current changing process is performed. In the drive current changing process, the controller 900 controls the current supply unit 100 such that the current supply unit 100 performs a process for setting the current value of a current to be supplied to one or more normal light sources to be smaller than or equal to the rated value of the normal light source. Specifically, in the drive current changing process, the controller 900 controls the current supply unit 100 to change the value of the drive current If0 such that the relationship of Expression 7 is established. For example, the current supply unit 100 performs a process for setting the current values of the currents to be supplied to the light sources 11-2 to 11-4, being normal light sources, to be smaller than or equal to the rated value (4.5) of the normal light source. The process then moves to Step S450 included in the switch control process (S400).

In the process C5 performed in the presence of a faulty light source, therefore, the controller 900 controls the current supply unit 100 when the relationship of Expression 7 is not established or does not control the current supply unit 100 when the relationship of Expression 7 is established.

In Step S450, a process S5 is performed. The process S5 is similar to the process S1. Specifically, in the process S5, the controller 900 controls, by controlling (via) the switching control circuit 15, the switching unit 140 such that the switch 14-1 is turned off. In this case, the light sources 11-2, 11-3, and 11-4 light up, and the light sources 11-2, 11-3, and 11-4 are used as the light sources for the image display apparatus to display an image. After the process of Step S450, Step S500 above is performed.

In the presence of an open-circuit-fault light source, Steps S350 and S450 are performed, so that the controller 900 performs a process N2 below. In the process N2, when the relationship of Expression 7 is not established, the controller 900 controls the current supply unit 100 and the switching unit 140 as described above such that a current is continuously supplied to normal light sources. In the process N2, meanwhile, when the relationship of Expression 7 is established, the controller 900 controls the switching unit 140 as described above such that a current is continuously supplied to normal light sources. Specifically, when a faulty light source (open-circuit-fault light source) is present, the controller 900 controls at least one of the current supply unit 100 and the switching unit 140 such that a current is continuously supplied to normal light sources.

Next, the process in the case of NO in Step S143 above is described. As described above, the process moves to Step S144 if it is determined NO in Step S143.

In Step S144, the controller 900 determines that the relationship of Expression 8 is established. The process then moves to Step S160.

Hereinafter, a state in which DD1 is not zero and the relationship of Expression 8 is established is also referred to as a "state K1." In the state K1, If1 is not 0 A. At the occurrence of the state K1 during driving of the light source unit 110, the state of the light source unit 110 is the open-circuit fault state (that is, an open-circuit-fault light source is present). In the state K1, when the relationship of Expression 8 is maintained when switches 14 respectively corresponding to the light sources 11 are sequentially turned off, whereby only a single switch 14 is always turned off, the light source 11 is an open-circuit-fault light source.

In Step S160, a state determining process A2 is performed. In the state determining process A2, the controller 900 determines the state of the light source unit 110 on the basis of the values indicated in the pieces of digital data DD0 and DD1. The state determining process A2 is performed in the state K1 above. As described above, at the occurrence of the state K1 during driving of the light source unit 110, the state of the light source unit 110 is the open-circuit fault state (that is, an open-circuit-fault light source is present).

In the state determining process A2, thus, the controller 900 determines that the state of the light source unit 110 is the open-circuit fault state. In the state determining process A2, the controller 900 also performs a sequentially-turning-off control process Z. The sequentially-turning-off control process Z is the same as the sequentially-turning-off control process K. The sequentially-turning-off control process K has been described in detail, which is not described below in detail.

In the sequentially-turning-off control process Z, as in the sequentially-turning-off control process K, the switches 14-1 to 14-4 are sequentially turned off and then turned on, where only a single switch is always turned off. In the state determining process A2, when any of the switches 14-1 to 14-4 is turned off in the sequentially-turning-off control process Z, any of the states STx2, STx3, and STx4 occurs.

In each of the states STx2, STx3, and STx4, when the DD1 is not zero and the relationship of Expression 8 is established upon turning off of the switch 14 in the sequentially-turning-off control process Z, any of the light sources 11-2, 11-3, and 11-4 provided in the current path including the switch 14 is an open-circuit-fault light source. For example, in the state STx2, the light source 11-2 provided in the current path including the switch 14-2 turned off in the sequentially-turning-off control process Z is an open-circuit-fault light source. For example, in the state STx4, the light source 11-4 provided in the current path including the switch 14-4 turned off in the sequentially-turning-off control process Z is an open-circuit-fault light source.

At the occurrence of the state STx2 in the state determining process A2, the process moves to Step S260 included in the faulty light source identifying process (S200), with the switch 14-2 remaining turned off.

In Step S260, DD1 is not zero and the relationship of Expression 8 is established in the state STx2, and thus, the controller 900 determines that the light source 11-2 has an open-circuit fault. Specifically, the controller 900 determines that an open-circuit-fault light source is the light source 11-2. The controller 900 also determines that the state of the light source unit 110 is the open-circuit fault state. The process then moves to Step S360 included in the drive current control process (S300).

In Step S360, a process C6 is performed. The process C6 is the same as the process C1, which is not described below in detail. The process then moves to Step S460 included in the switch control process (S400).

In Step S460, a process S6 is performed. In the process S6, the controller 900 controls, by controlling (via) the switching control circuit 15, the switching unit 140 such that the switch 14-2 remains turned off. In this case, the light sources 11-1, 11-3, and 11-4 light up, and the light sources 11-1, 11-3, and 11-4 are used as the light sources for the image display apparatus to display an image. After the process of Step S460, Step S500 above is performed.

At the occurrence of the state STx3 in the state determining process A2, the process moves to Step S270 included in the faulty light source identifying process (S200), with the switch 14-3 remaining turned off.

In Step S270, DD1 is not zero and the relationship of Expression 8 is established in the state STx3, and thus, the controller 900 determines that the light source 11-3 has an open-circuit fault. Specifically, the controller 900 determines that an open-circuit-fault light source is the light source 11-3. The controller 900 also determines that the state of the light source unit 110 is the open-circuit fault state. The process then moves to Step S370 included in the drive current control process (S300).

In Step S370, a process C7 is performed. The process C7 is the same as the process C1, which is not described below in detail. The process then moves to Step S470 included in the switch control process (S400).

In Step S470, a process S7 is performed. In the process S7, the controller 900 controls, by controlling (via) the switching control circuit 15, the switching unit 140 such that the switch 14-3 remains turned off. In this case, the light sources 11-1, 11-2, and 11-4 light up, and the light sources 11-1, 11-2, and 11-4 are used as the light sources for the image display apparatus to display an image. After the process of Step S470, Step S500 above is performed.

At the occurrence of the state STx4 in the state determining process A2, the process moves to Step S280 included in the faulty light source identifying process (S200), with the switch 14-4 remaining turned off. The state STx4 in the state determining process A2 is the same as the state STc2. In the state STx4, accordingly, DD0 and DD1 are 40 and 120, respectively.

In Step S280, DD1 is not zero and the relationship of Expression 8 is established in the state STx4, and thus, the controller 900 determines that the light source 11-4 has an open-circuit fault. Specifically, the controller 900 determines that an open-circuit-fault light source is the light source 11-4. The controller 900 also determines that the state of the light source unit 110 is the open-circuit fault state. The process then moves to Step S380 included in the drive current control process (S300).

In Step S380, a process C8 is performed. The process C8 is the same as the process C1, which is not described below in detail. The process then moves to Step S480 included in the switch control process (S400).

In Step S480, a process S8 is performed. In the process S8, the controller 900 controls, by controlling (via) the switching control circuit 15, the switching unit 140 such that the switch 14-4 remains turned off. In this case, the light sources 11-1, 11-2, and 11-3 light up, and the light sources 11-1, 11-2, and 11-3 are used as the light sources for the image display apparatus to display an image. After the process of Step S480, Step S500 above is performed.

As described above, according to this preferred embodiment, the controller 900 determines whether the light sources 11-1 to **11-*m* (m is a natural number not less than three) connected in parallel include a faulty light source. When a faulty light source is included, the controller 900 controls at least one of the current supply unit 100 and the switching unit 140 such that a current is continuously supplied to normal light sources being light sources of the light sources 11-1 to 11-*m*** except for the faulty light source.

Consequently, the light source 11 can continuously emit light if a fault occurs in any of a plurality of parallel-connected light sources.

According to this preferred embodiment, the controller 900 determines whether the light sources 11-1 to **11-*m* connected in parallel include a faulty light source on the basis of the drive current If0 and the current If1. Specifically, whether a faulty light source is present can be determined by sensing the currents at two positions. Thus, a current sensing unit needs not to be provided for every current path of each light source 11. This can reduce the cost of the light source control apparatus 1000**.

According to this preferred embodiment, in the presence of a faulty light source, a faulty light source can be identified by two current sensing units (current sensing units 130 and 131) and two conversion units 20 serving as the channels that perform AD conversion. The current sensing unit 130 senses a drive current If0 for the user to acquire a desired luminance. The current sensing unit 131 is provided in any one of the current paths for a plurality of light sources 11. Specifically, a faulty light source can be identified using two current sensing units irrespective of the number of parallel-connected light sources 11. Thus, also after a fault occurs in a light source, a light source (light source unit 110) that can be used for image display is available to the user.

According to this preferred embodiment, it suffices that the number of current sensing units having a function of sensing a current is two regardless of the number of parallel-connected light sources 11. This enables sensing of a fault of the light source 11 at a minimum cost.

According to this preferred embodiment, also in the presence of a faulty light source, a current of an optimum current value, which is calculated for the rated value of the normal light source (light source 11), can be supplied to the normal light source. Also in the presence of a faulty light source, thus, a light source (light source unit 110) that emits optimum-luminance light can be provided. Therefore, a safe-quality light source control apparatus 1000 can be provided.

According to this preferred embodiment, in the presence of a faulty light source, the controller 900 controls the current supply unit 100 such that the current supply unit 100 performs a process for setting the current value of a current to be supplied to one or more normal light sources to be smaller than or equal to the rated value of the normal light source. Also if a fault occurs in a light source, thus, an optimum current corresponding to an appropriate luminance can be supplied to a normal light source without causing a further fault in another light source (normal light source). A light source (light source unit 110) in good state, which emits optimum-luminance light, can be accordingly provided to the user.

In the light source control apparatus 1000 according to this preferred embodiment, the sensing resistor R0 and the current sensing unit 130 cannot be eliminated for accurate control of the drive current If0 supplied to the light source unit 110 by the current supply unit 100.

However, one current sensing unit for fault sensing needs not to be provided for each of the light sources 11 constituting a light source unit 110. Specifically, in the light source control apparatus 1000, one current sensing unit 131 is provided for any one of the light sources 11. This allows two current sensing units (the current sensing units 130 and a minimum number of current sensing units) to sense a fault of the light source 11. This can reduce current sensing units for fault sensing compared with a conventional light source control apparatus including one current sensing unit for fault sensing for each of the light sources 11. This can reduce a manufacturing cost of the light source control apparatus 1000.

This preferred embodiment has described the drive current managing process when the number of light sources 11 is four. The number of light sources 11, however, is not limited to four and may be two, three, or five or more. In this preferred embodiment, with the provision of two current sensing units and two conversion units 20 serving as channels that perform AD conversion, faults in all the light sources 11 can be sensed. The two current sensing units are a current sensing unit 130 that senses a drive current If0 for the user to acquire a desired luminance and a current sensing unit 131 provided in any one of the current paths for a plurality of light sources 11.

The light source control apparatus 1000 supplies an optimum current to the normal light sources without causing a fault in the normal light sources except for a faulty light source, thereby causing the normal light sources to individually light up. This can provide a light source (light source unit 110) for continuously displaying an image to the user.

This preferred embodiment performs the information display process of FIG. 4. The information display process displays the faulty light source information. As a result, a fault state of the light source 11 can be disclosed to the user. In other words, the information on a faulty light source 11 can be conveyed to the user. Specifically, a light source in which a fault has occurred can be reported to the user, and the replacement of the faulty light source 11 can be encouraged. Therefore, the light source control apparatus 1000 can be recovered quickly before faults occur in all the light sources 11.

The faulty light source information is displayed by the image display apparatus in the information display process above, which is not limited thereto. The faulty light source information may be displayed by, for example, a control personal computer that controls the light source control apparatus 1000 or a liquid crystal display.

As described above, the light source 11 is not limited to an LED and may be, for example, a semiconductor light source such as a laser.

The specifications and characteristics of the current sensing units 130 and 131 and the AD converter 200, described in this preferred embodiment, are merely examples and may not be limited thereto as long as similar effects can be achieved.

The controller 900 controls each switch 14, the current supply unit 100, and the like in accordance with a predetermined program in this preferred embodiment, which is not limited thereto. The controller 900 may be configured to cause, for example, hardware such as an electric circuit to control each switch 14, the current supply unit 100, and the like. Such a configuration can achieve effects similar to the above.

Other Modifications

While the light source control apparatus according to the present invention has been described in the preferred embodiment, the present invention is not limited to the preferred embodiment. The present invention includes modifications made to the preferred embodiment above by persons ordinarily skilled in the art without departing from the scope of the present invention. In the present invention, accordingly, the preferred embodiment can be appropriately modified or omitted within the scope of the invention.

The light source control apparatus 1000 may include none of the components shown in FIG. 1 or 2. Specifically, the light source control apparatus 1000 may include only a minimum number of components enough to achieve the effects of the present invention.

The present invention may be implemented as a light source control method including, as its steps, the operations of characteristic components included in the light source control apparatus 1000. The present invention may be implemented as a program that causes a computer to execute steps included in such a light source control method. The present invention may be implemented as a computer-readable recording medium that stores such a program. The program may be distributed via a transmission medium such as the Internet.

The light source control method according to the present invention corresponds to a part or the whole of the processes of FIG. 4. The light source control method according to the present invention does not necessarily need to include all the corresponding steps in FIG. 4. Specifically, the light source control method according to the present invention is only required to include a minimum number of steps that can achieve the effects of the present invention. The light source control method according to the present invention may include, for example, only Steps S140, S300, and S400 of FIG. 4. The light source control method according to the present invention does not necessarily need to execute, for example, Step S500 of FIG. 4.

The sequence of the steps to be executed in the light source control method is merely an example for specifically describing the present invention, and the steps may be executed in another sequence. A part of the steps of the light source control method and the other steps may be executed independently of each other in parallel.

A part of the components of the light source control apparatus 1000 may be typically implemented as a large scale integration (LSI) being an integrated circuit. For example, in the light source control apparatus 1000, the controller 900, the switching unit 140, the current sensing units 130 and 131, and the switching control circuits 15-1 to **15-*m*** may be implemented as an integrated circuit.

All the numeric values used in this preferred embodiment are merely examples for specifically describing the present invention. In other words, the present invention is not limited to the numeric values used in this preferred embodiment.

The preferred embodiment of the present invention can be appropriately modified or omitted within the scope of the invention.

While a configuration including one current sensing unit (current sensing unit 131) for fault sensing is provided in the preferred embodiment, a configuration (hereinafter, also referred to as a "modified configuration A") including u ($2 \leq u < m$) current sensing units for fault sensing may be provided. Hereinafter, the current sensing unit for fault sensing is also referred to as a "fault-handling current sensing unit."

In the modified configuration A, for example, when u=2, the light source control apparatus 1000 of FIG. 1 includes, for example, a fault-handling current sensing unit (hereinafter, also referred to as a "fault-handling current sensing unit A") in the current path for the light source 11-2, in addition to the fault-handling current sensing unit (current sensing unit 131) provided in the current path for the light source 11-1. In this case, the fault-handling current sensing unit A is electrically connected in parallel to the sensing resistor R1-2. The fault-handling current sensing unit A senses a current If2. The AD converter 200 transmits digital data DD2 corresponding to the current value of the sensed current If2 to the controller 900 as required.

In the light source control apparatus 1000 to which the modified configuration A is applied, when u=2, the light source control apparatus 1000 includes two current sensing units that sense the currents If1 and If2 respectively supplied to two light sources 11. Specifically, the light source control apparatus 1000 includes a fault-handling current sensing unit (current sensing unit 131) that senses a current If1 supplied to a light source 11-1 and a fault-handling current sensing unit A that senses a current If2 supplied to a light source 11-2.

In the light source control apparatus 1000 to which the modified configuration A is applied, when u=2 and a fault occurs in any of the light sources 11, a time required for identifying the faulty light source 11 can be reduced compared with the case where the number of fault-handling current sensing units is one.

While the invention has been shown and described in detail, the foregoing description is in all aspects illustrative and not restrictive. It is therefore understood that numerous modifications and variations can be devised without departing from the scope of the invention.

What is claimed is:

1. A light source control apparatus that controls a plurality of light sources that are connected in parallel and emit light when supplied with a current, said apparatus comprising:

a current supply unit that collectively supplies a current to said plurality of light sources;

a first current sensing unit that senses a first current being said current collectively supplied to said plurality of light sources by said current supply unit;

a second current sensing unit that senses a second current being a current supplied to at least one of said plurality of light sources;

a switching unit having a function of stopping the supply of a current to each of said plurality of light sources; and a controller that determines whether said plurality of light sources include a faulty light source on the basis of said first current and said second current, wherein when said plurality of light sources include said faulty light source, said controller further controls at least one of said current supply unit and said switching unit such that a current is continuously supplied to a normal light source being a light source of said plurality of light sources except for said faulty light source.

2. The light source control apparatus according to claim 1, wherein said controller identifies said faulty light source on the basis of said first current and said second current.

3. The light source control apparatus according to claim 1, wherein said faulty light source is a light source that has a short-circuit fault, when said plurality of light sources include said faulty light source, said switching unit stops the supply of a current to said faulty light source, and said current supply unit performs a process for setting a current value of a current to be supplied to said normal light source to be smaller than or equal to a rated value of said normal light source.

4. The light source control apparatus according to claim 1, wherein said faulty light source is a light source that has an open-circuit fault, and when said plurality of light sources include said faulty light source, said current supply unit performs a process for setting a current value of a current to be supplied to said normal light source to be smaller than or equal to a rated value of said normal light source.

5. A light source control method to be performed by a light source control apparatus that controls a plurality of light sources that are connected in parallel and emit light when supplied with a current, said light source control apparatus comprising:

a current supply unit that collectively supplies a current to said plurality of light sources;

a first current sensing unit that senses a first current being said current collectively supplied to said plurality of light sources by said current supply unit;

a second current sensing unit that senses a second current being a current supplied to at least one of said plurality of light sources; and a switching unit having a function of stopping the supply of a current to each of said plurality of light sources, said method comprising:

determining whether said plurality of light sources include a faulty light source on the basis of said first current and said second current; and controlling, when the plurality of light sources include said faulty light source, at least one of said current supply unit and said switching unit such that a current is continuously supplied to a normal light source being a light source of said plurality of light sources except for said faulty light source.

* * * * *